US005588383A

United States Patent [19]

Davis et al.

[11] Patent Number: 5,588,383

[45] Date of Patent: Dec. 31, 1996

[54] APPARATUS AND METHOD FOR PRODUCING PATTERNED TUFTED GOODS

[75] Inventors: David L. Davis, Indianola; Michael J. Black, Seattle; Richard A. Dolf, Seattle; Sean E. Gorman, Seattle; John M. Havard, Seattle; Milton R. Sigelmann, Seattle, all of Wash.

[73] Assignee: Tapistron International, Inc., Ringgold, Ga.

[21] Appl. No.: 397,742

[22] Filed: Mar. 2, 1995

[51] Int. Cl.[6] ..... D05C 15/24

[52] U.S. Cl. ..... 112/80.16; 112/80.6

[58] Field of Search ..... 112/80.01, 80.08, 112/80.16, 80.55, 80.56, 80.58, 80.59, 80.6; 83/698.71, 699.11, 697; 30/492

[56] References Cited

U.S. PATENT DOCUMENTS

| | | | |
|---|---|---|---|
| Re. 30,920 | 5/1982 | Zollinger . | |
| Re. 31,024 | 9/1982 | Zollinger . | |
| Re. 31,041 | 9/1982 | Zollinger . | |
| D. 253,952 | 1/1980 | McBride . | |
| 2,528,392 | 10/1950 | Self . | |
| 2,599,226 | 6/1952 | Briem . | |
| 2,818,037 | 12/1957 | McNutt . | |
| 2,840,019 | 6/1958 | Beasley . | |
| 2,932,181 | 4/1960 | MacCaffray, Jr. . | |
| 3,091,199 | 5/1963 | Ballard . | |
| 3,216,387 | 11/1965 | Short . | |
| 3,217,675 | 11/1965 | Short . | |
| 3,217,676 | 11/1965 | Short . | |
| 3,247,814 | 4/1966 | Polevitzky . | |
| 3,324,812 | 6/1967 | Smith | 112/80.55 |
| 3,386,398 | 6/1968 | Cobble, Sr. et al. | 112/80.6 |
| 3,386,403 | 6/1968 | Short . | |
| 3,424,114 | 1/1969 | Short . | |
| 3,459,143 | 8/1969 | Ellison et al. . | |
| 3,502,044 | 3/1970 | Brown et al. . | |
| 3,550,543 | 12/1970 | Crawford . | |
| 3,595,186 | 7/1971 | Shorrock et al. . | |
| 3,650,228 | 3/1972 | Lynch . | |
| 3,895,355 | 7/1975 | Shorrock . | |
| 3,922,979 | 12/1975 | Ingham et al. . | |
| 3,937,157 | 2/1976 | Spanel et al. . | |

(List continued on next page.)

FOREIGN PATENT DOCUMENTS

| | | |
|---|---|---|
| 1902169 | 8/1970 | Germany . |
| 2753087 | 5/1979 | Germany . |
| 54-81341 | 6/1954 | Japan . |
| 41-8648 | 5/1966 | Japan . |

(List continued on next page.)

*Primary Examiner*—Paul C. Lewis
*Attorney, Agent, or Firm*—Jones & Askew

[57] ABSTRACT

An apparatus for tufting yarn in a backing comprising a yarn applicator for penetrating the backing and implanting the yarn therein and an electric motor for supplying a predetermined length of the yarn to the yarn applicator. The electric motor is operable to selectively advance the predetermined length of yarn to the yarn applicator, and alternatively, hold the yarn or retract the yarn from the applicator. Desirably, the electric motor is a stepper motor, and more desirably, the apparatus comprises a plurality of stepper motors for selectively feeding yarns to a row of reciprocable hollow tufting needles for producing a patterned tufted product. According to one aspect, the tufting apparatus composes a modular supply system and a corresponding modular control system. Pattern information and timing signals are sent to modular yarn control units by a remote process control computer system. According to another aspect, an apparatus for tufting yarn in a backing is provided wherein a flexible yarn supply tube extends from the outlet of a stationary manifold to the inlet of a reciprocable needle mount for a hollow tufting needle, so that during reciprocation of the needle, yarn does not move relative to a yarn feed path due to the reciprocation of the needle. This allows for yarn to be fed to the needle during the entire needle reciprocation cycle. A yarn movement monitoring apparatus, a yarn movement managing apparatus, a needle assembly for tufting yarn in a backing, and a knife assembly for mounting to a frame and cutting yarn implanted into a backing by a hollow needle are also encompassed.

3 Claims, 22 Drawing Sheets

U.S. PATENT DOCUMENTS

| | | | |
|---|---|---|---|
| 3,943,865 | 3/1976 | Short et al. . | |
| 3,964,408 | 6/1976 | Smith . | |
| 3,964,411 | 6/1976 | Smith . | |
| 3,972,295 | 8/1976 | Smith . | |
| 4,005,833 | 2/1977 | Zollinger . | |
| 4,061,095 | 12/1977 | Price | 112/80.6 |
| 4,078,505 | 3/1978 | Fitton et al. . | |
| 4,094,447 | 6/1978 | Gellert . | |
| 4,119,049 | 10/1978 | Puckett . | |
| 4,123,985 | 11/1978 | Frentress . | |
| 4,166,423 | 9/1979 | Brienza et al. . | |
| 4,173,192 | 11/1979 | Schmidt et al. . | |
| 4,188,902 | 2/1980 | Kahan . | |
| 4,254,718 | 3/1981 | Spanel et al. . | |
| 4,267,787 | 5/1981 | Fukuda . | |
| 4,279,388 | 7/1981 | McBride, Jr. . | |
| 4,361,171 | 11/1982 | Fukuda . | |
| 4,403,754 | 9/1983 | McBride, Jr. . | |
| 4,406,424 | 9/1983 | McBride . | |
| 4,430,870 | 2/1984 | Winter et al. . | |
| 4,470,559 | 9/1984 | McBride, Jr. . | |
| 4,549,496 | 10/1985 | Kile . | |
| 4,557,208 | 12/1985 | Ingram et al. . | |
| 4,605,182 | 8/1986 | Zollinger . | |
| 4,678,533 | 7/1987 | Bartlett et al. . | |
| 4,682,554 | 7/1987 | Goto et al. . | |
| 4,722,288 | 2/1988 | Nomura et al. . | |
| 4,738,209 | 4/1988 | Yanagi et al. . | |
| 4,807,829 | 2/1989 | Zollinger . | |
| 4,824,043 | 4/1989 | Zollinger . | |
| 4,867,080 | 9/1989 | Taylor et al. . | |
| 4,931,129 | 6/1990 | Bartlett et al. . | |
| 4,981,091 | 1/1991 | Taylor et al. . | |
| 4,991,523 | 2/1991 | Ingram . | |
| 5,005,498 | 4/1991 | Taylor et al. . | |
| 5,058,518 | 10/1991 | Card et al. . | |
| 5,080,028 | 1/1992 | Ingram . | |
| 5,158,027 | 10/1992 | Ingram | 112/80.08 |
| 5,165,352 | 11/1992 | Ingram | 112/80.08 |
| 5,205,233 | 4/1993 | Ingram . | |
| 5,267,520 | 12/1993 | Ingram | 112/410 |

FOREIGN PATENT DOCUMENTS

| | | |
|---|---|---|
| 46-31306 | 9/1971 | Japan . |
| 54-92450 | 7/1979 | Japan . |
| 54-92451 | 7/1979 | Japan . |
| 54-92448 | 7/1979 | Japan . |
| 55-6519 | 1/1980 | Japan . |
| 56-38702 | 9/1981 | Japan . |
| 60-5029 | 2/1985 | Japan . |
| 1139830 | 1/1969 | United Kingdom . |
| 1169952 | 11/1969 | United Kingdom . |
| 2052101 | 4/1983 | United Kingdom . |
| 2051897 | 10/1983 | United Kingdom . |

APPARATUS AND METHOD FOR PRODUCING PATTERNED TUFTED GOODS

TECHNICAL FIELD

This invention relates generally to tufting apparatus for producing patterned textile goods such as carpet, upholstery, and the like, and more particularly to tufting apparatus for producing tufted goods having a multicolor pattern by selectively feeding different yarns to a row of reciprocating hollow needles which implant the yarns into a transversely shifting backing material.

BACKGROUND OF THE INVENTION

U.S. Pat. No. 4,549,496 to Kile discloses a tufting apparatus for producing patterned tufted goods using yarns of different colors. This apparatus is capable of selectively implanting yarns of different colors into a backing to produce a tufted product having a predetermined multicolored pattern. The patent apparatus employs multiple heads spaced across the width of a backing material. Each head comprises a hollow needle for penetrating the backing and implanting yarn tufts in the backing by reciprocating the head and feeding yarn through the needle pneumatically. This device uses a system of gears and rollers to select the desired yarn for implantation into the backing for each penetration by the needle. The multiple heads are stepped in synchronism across the backing for a distance corresponding to the spacing between the heads in order to implant a transverse row of yarn tufts. This process is repeated as the backing is advanced to complete the product. A computer controls the selection of yarn implanted by each needle for each penetration of the backing in order to reproduce the desired pattern in the finished goods.

The apparatus disclosed in the Kile patent and its method of operation have been subsequently modified. Such modifications are disclosed in U.S. Pat. Nos. 4,991,523; 5,080,028; 5,165,352; 5,158,027; 5,205,233; and 5,267,520, all to Ingram. These subsequent patents disclose an apparatus in which the backing is shifted transversely relative to the reciprocating needles while the backing advances through the apparatus. Thus, rather than the multiple heads which carry the hollow needles being moved across the backing, the subsequent patents disclose an apparatus wherein the backing rather than the heads is shifted transversely. In addition, the device disclosed in the Ingram patents comprises a plurality of hollow needles carried on a widthwise extending member. As the yarn is implanted by the reciprocating needles, the backing is shifted in the transverse direction by an amount corresponding to the spacing between adjacent needles in order to implant a transverse row of tufts. A knife blade is associated with each needle and positioned on the opposite of the backing for cutting the yarn at the lower position of the needle.

The apparatus disclosed in the Ingram patents further includes a mechanism for supplying continuous lengths of the different yarns to the needles comprising a system of gears. More specifically, this yarn supply mechanism includes a main rotatable gear shaft tied to and driven by the main drive shaft that reciprocates the needles. A plurality of small gears extending along the length of the main gear shaft are selectively engagable with the main gear shaft to feed the desired yarns to the needles. The individual gears for feeding the yarns are selectively shifted in and out of meshing cooperation with the main gear shaft by air solenoids. Once the yarn is fed by the gear system, the yarn is drawn to and out of the needle by pressurized air from a manifold mounted to the reciprocating needle mounting bar.

Another mechanical system is used to retract yarns from the needles when other yarns are desired to be implanted. The retraction mechanism includes a reciprocating plunger disposed between two yarn guides. The reciprocating plunger pulls the yarn to be retracted out of the needle.

Although the tufting apparatus disclosed in the Kile and Ingram patents performs well, there is a need for a tufting apparatus for producing patterned textile goods with increased throughput and increased reliability, particularly in high temperature and elevated humidity environments. In addition, it is desirable to have an apparatus for producing patterned tufted goods with both cut and loop stitching or tufting.

SUMMARY OF THE INVENTION

The present invention achieves the above- described objectives and encompasses a yarn tufting apparatus, a method for tufting yarn, and various components of a yarn tufting apparatus.

According to one aspect, the present invention encompasses an apparatus for tufting yarn in a backing comprising one or more electric motors, desirably stepper motors for supplying predetermined lengths of different yarns to a yarn applicator rather than using a system of mechanical gears and rollers to supply the yarns. Each electric motor is operable to selectively advance the predetermined length of yarn to the yarn applicator and alternatively, hold the yarn or retract the yarn from the applicator. Stepper motors very quickly and accurately advance specific lengths of yarn to the yarn applicator. More desirably, the stepper motors comprise a rotor including a rare earth disk magnet. Such stepper motors have a low rotor inertia, low mass, and good acceleration and power at high speed for fast incremental motion.

More particularly, the apparatus of the present invention produces patterned tufted goods and comprises a tufting frame, a backing transport system mounted to the frame, a yarn applicator, a yarn supply module, and a control system for controlling the tufting apparatus. The backing transport system advances a backing material in a direction past a yarn applying region and moves the backing transversely to the direction of advancement of the backing. The yarn applicator is disposed at the yarn applying region and is mounted to the frame. The yarn applicator penetrates the backing and implants yarn therein successively along a transverse row during transverse movement of the backing. The yarn supply module supplies a plurality of continuous lengths of different yarns to the yarn applicator. In addition, the yarn supply module is selectively moveable between an operating position, and alternatively, an outward maintenance position. The yarn supply module comprises a yarn supply frame and a plurality of electric motors which are mounted to the yarn supply frame and correspond to the plurality of lengths of yarns. The electric motors independently supply predetermined lengths of the continuous lengths of yarns to the yarn applicator. In addition, the electric motors are operable to selectively advance the predetermined lengths of yarns to the yarn applicator, and alternatively, hold the yarns or retract the yarns from the applicator. The control system controls the yarn supply module in accordance with a predetermined pattern to select which of the continuous lengths of yarns, if any, is implanted in the backing at each penetration.

The use of electric motors, and in particular, stepper motors, provides for quick and accurate delivery of yarn to the yarn applicator, which is preferably a reciprocating hollow needle. Thus, electric motors increase the throughput and the reliability of tufting apparatus for producing patterned tufted goods.

Still more particularly, the control system of the tufting apparatus controls the speed and movement of the reciprocating needle and generates data representing the position and speed of movement of the needle, receives data for use in deriving timing signals for controlling the timing of the stepper motors, derives the timing signals by manipulating the needle position, speed data, and the timing signal data, receives data for use in controlling the yarn supply module in accordance with a predetermined pattern to select which of the continuous lengths of yarn, if any, is implanted in the backing at each penetration, and controls the stepper motors in accordance with the timing signals and pattern data.

Desirably, the control system for the tufting apparatus comprises a process control computer system remote from the tufting frame and a yarn control module which is mounted to the tufting frame and comprises a computer. The process control computer system controls the position and speed of movement of the needle, generates data representing the position and speed of movement of the needle, receives data for use in deriving timing signals for controlling the timing of the stepper motors, derives the timing signals by manipulating the needle position and speed data and the timing signal data, transmits the timing signals, receives pattern data for use in controlling the yarn supply module in accordance with a predetermined pattern to select which of the continuous lengths of yarns, if any, is implanted in the backing material at each penetration, generates signals representing the pattern data, and transmits the pattern signals. The computer of the yarn control module is disposed in a housing and receives the timing and pattern signals from the process control computer system and controls the stepper motors in accordance with the timing and pattern signals.

Desirably, the tufting apparatus of the present invention comprises a plurality of the above-described yarn supply modules mounted to the tufting frame and extending along the length of the tufting frame and a plurality of yarn control modules mounted to the tufting frame and extending along the length of the tufting frame for controlling respective yarn supply modules.

According to another aspect, the present invention provides an apparatus for tufting yarn in a backing comprising a flexible yarn supply tube extending from an outlet of a stationary manifold to a reciprocable needle mount having a passage extending to a hollow needle which is mounted to the needle mount. When the needle and needle mount are reciprocated so as to repetitively penetrate the backing with the needle, the manifold remains stationary, so that the distance of the yarn feed path remains the same during the reciprocation of the needle and the needle mount, and the reciprocation of the needle and needle mount does not cause movement of the yarn relative to the feed path.

More specifically, this apparatus comprises a tufting frame, the manifold and reciprocable needle and needle mount being mounted to the tufting frame. The apparatus further comprising a backing transport system mounted to the frame for advancing a backing past a yarn applying region. The needle has an elongate hollow passage extending from an inlet to an outlet at a tip for penetrating the backing and implanting yarn therein. The needle mount has a passage extending from an inlet to an outlet and the needle is mounted to the needle mount, so that the outlet of the needle mount communicates with the inlet of the needle. The manifold receives a flow of pressurized air, is fixed to the tufting frame, and has a passage extending from an inlet to an outlet. The flexible yarn supply tube extends from the manifold to the inlet of the needle mount, so that when the manifold receives the flow of pressurized air, the air flows into the manifold inlet and through the manifold passage, the yarn supply tube, the needle mount passage, and the needle passage, and out the needle outlet tip. The yarn supply, the needle mount passage, and the needle passage defining a yarn feed path extending from the manifold outlet to the needle outlet tip. A yarn supply system feeds yarn selectively to the yarn supply tube to transport the yarn through the needle mount and needle for implantation into the backing at each penetration thereof. A needle drive system reciprocates the needle and the needle mount. Desirably, the apparatus produces patterned tufted goods and comprises a plurality of such flexible yarn tubes for supplying a plurality of different yarns to the needle.

The present invention also encompasses a method for tufting yarn with an apparatus such as that described hereinbefore comprising the step of feeding the yarns selectively to the flexible yarn supply tube to transport the yarn through the needle mount and the needle for implantation of the yarn tufts into the backing material at each penetration thereof, each tuft comprising a length of yarn, a first portion of the length of yarn being fed on the respective upstroke and a remaining portion of the length of yarn being fed on the downstroke of the needle reciprocation cycle. This allows the yarn to be fed to the needle during the entire reciprocation cycle of the needle.

According to still another aspect of the present invention, an apparatus and method for monitoring movement of a yarn with respect to a command signal are provided. This apparatus comprises a frame, a wheel rotatably mounted to the frame for rotation in response to movement of the yarn, and a sensor for detecting rotation of the wheel. Furthermore, the apparatus (1) in response to the sensor, provides a motion signal, (2) in response to the command signal, compares the motion signal to the command signal, and (3) in response to the comparing the motion signal to the command signal, indicates when the command signal and motion do not match. This apparatus is useful in detecting jammed or broken yarns. When used on a tufting apparatus, the yarn monitoring apparatus can be used for identifying jammed or broken yarns and correct the problem before a defective product is produced.

Desirably, the sensor in the yarn movement monitoring apparatus comprises a slotted disk including radially extending sections of alternating phototransmission capability. This disk is rotatably connected to the wheel and an optoelectronic sensor is disposed proximate the slotted disk. The optoelectronic sensor detects movement of the yarn and is desirably an LED/phototransistor.

More particularly, the yarn movement monitor of the present invention is mounted to a yarn supply module for monitoring movement of yarn through the yarn supply module. Desirably, the yarn supply module includes an indicator means, such as a visual alarm, to indicate when a movement of the yarn does not correspond to the command signal. In other words, the monitor, through the visual alarm, indicates when a yarn breaks or jams.

Still more desirably, a yarn supply module comprises a plurality of the above-described yarn movement monitors which correspond to a plurality of electric motors for independently supplying predetermined lengths of continuous lengths of yarns. The yarn supply module preferably further comprises a visual alarm for indicating when movement of a particular yarn does not correspond to a respective command signal.

According to yet another aspect of the present invention, an apparatus and method for managing movement of yarn are provided. The yarn managing apparatus comprises a yarn supplier for moving a continuous length of yarn and a filter member for filtering oversized portions of the yarn. The filter member has a peripheral edge defining an interior portion and a slot for receiving the yarn. The slot extends from an opening at the peripheral edge towards an interior end in the interior portion of the filter member. The slot is sized so that oversized portions of the yarn cannot pass through the slot and are held by the member at the slot. This apparatus prevents oversized portions of yarn such as knots from jamming in an associated device such as a tufting device.

Desirably, the yarn managing apparatus further comprises a yarn friction member positioned against the filter member at the slot for pinching the yarn between the filter member and friction member as the yarn exits the slot. This apparatus is useful for preventing free spooling of yarn from a spool and dampening yarn vibration.

Still more desirably, the yarn managing apparatus is mounted to an apparatus for producing patterned tufted goods and is capable of managing a plurality of moving yarns.

According to another aspect of the present invention, a needle assembly for tufting yarn in a backing is provided and comprises a hollow needle mounted to a bar. The needle has an inlet and an outlet at a pointed tip and the bar has a channel with opposing walls, a passage extending from an inlet to an outlet in the channel, and a protrusion extending from the bar between the opposing walls of the channel and adjacent the outlet. The needle is disposed in the channel between the protrusion and one of the opposing walls so that the needle inlet is in communication with the bar outlet and a screw extends through another of the opposing walls to the protrusion for selectively forcing the protrusion against the needle and fixing the needle to the bar, and alternatively, releasing the protrusion from against the needle for removal of the needle from the bar.

Another aspect of the invention is a knife assembly for mounting to a frame and cutting yarn implanted in a backing by a hollow needle. This knife assembly comprises a flat, elongate blade and a blade holder block. The blade has longitudinal edges and a cutting edge extending between the longitudinal edges for shearing engagement with the needle. The blade holder block has a passage for receiving the blade and a protrusion within the passage, the protrusion having a flat face. A screw extends through the block and into the passage for selectively engaging the flat blade and holding the blade flush against the flat face, and alternatively, releasing the blade. The longitudinal blade extends beyond the flat face when the blade is engaged by the screw, so that the blade can flex and conform to the needle when the blade engages the needle.

Still another aspect of the present invention is a tufting apparatus comprising a pneumatic system that prevents tangling of yarns being simultaneously fed and retracted through a hollow needle yarn applicator. The apparatus includes a yarn supply system for selectively and individually feeding any one of a plurality of different yarns through respective yarn supply tubes, holding any one of the plurality of yarns, and retracting any one of the plurality of yarns through the yarn supply tubes. A first pneumatic device produces an air flow through each yarn supply tube, the needle passage, and the needle, and transports the one of the plurality of different yarns being fed by the yarn supply system through the needle mount passage and needle, for implantation into the backing at each penetration of the needle. A second pneumatic device produces an air flow, independently of the yarn supply tubes, through the needle mount passage and the needle to prevent tangling of yarn within the needle mount passage. The second pneumatic device selectively produces the air flow at a first pressure, and alternatively, produces the air flow at a second pressure lower than the first pressure. A control system controls the yarn supply system in accordance with a predetermined pattern to (a) select which of the yarns is implanted at each penetration, (b) feed the one yarn to be implanted through the respective yarn supply tube, needle mount passage, and the needle for implantation into the backing, and (c) when another one of the plurality of yarns is to be implanted into the backing, change the yarn to be implanted by retracting through the needle mount passage the one yarn previously fed for implanting, and feeding, through the respective yarn supply tube, needle mount passage, and needle, the other yarn for implantation. The control system also controls the second pneumatic device in accordance with the predetermined pattern to selectively produce the air flow at the first pressure while changing the yarn to be implanted, and alternatively producing the air flow at the second pressure during operation of the tufting apparatus but not when yarns are being changed.

Accordingly, an object of the present invention is to provide an improved apparatus for producing patterned tufted goods.

Another object of the present invention is to provide an apparatus for producing, with increased reliability, patterned tufted goods.

Another object of the present invention is to provide an apparatus and method for producing patterned tufted goods at an increased throughput.

Other objects, features and advantages of the present invention will become apparent from the following detailed description, drawings, and claims.

DETAILED DESCRIPTION OF DRAWINGS

The tufting apparatus shown in FIG. 1 includes a number of subsystems which will be identified briefly below and then described in more detail thereafter. First, the structure of the apparatus 10 will be described in detail followed by a detail description of the operation of the tufting apparatus.

Structure of the Tufting Apparatus

Figure 1:
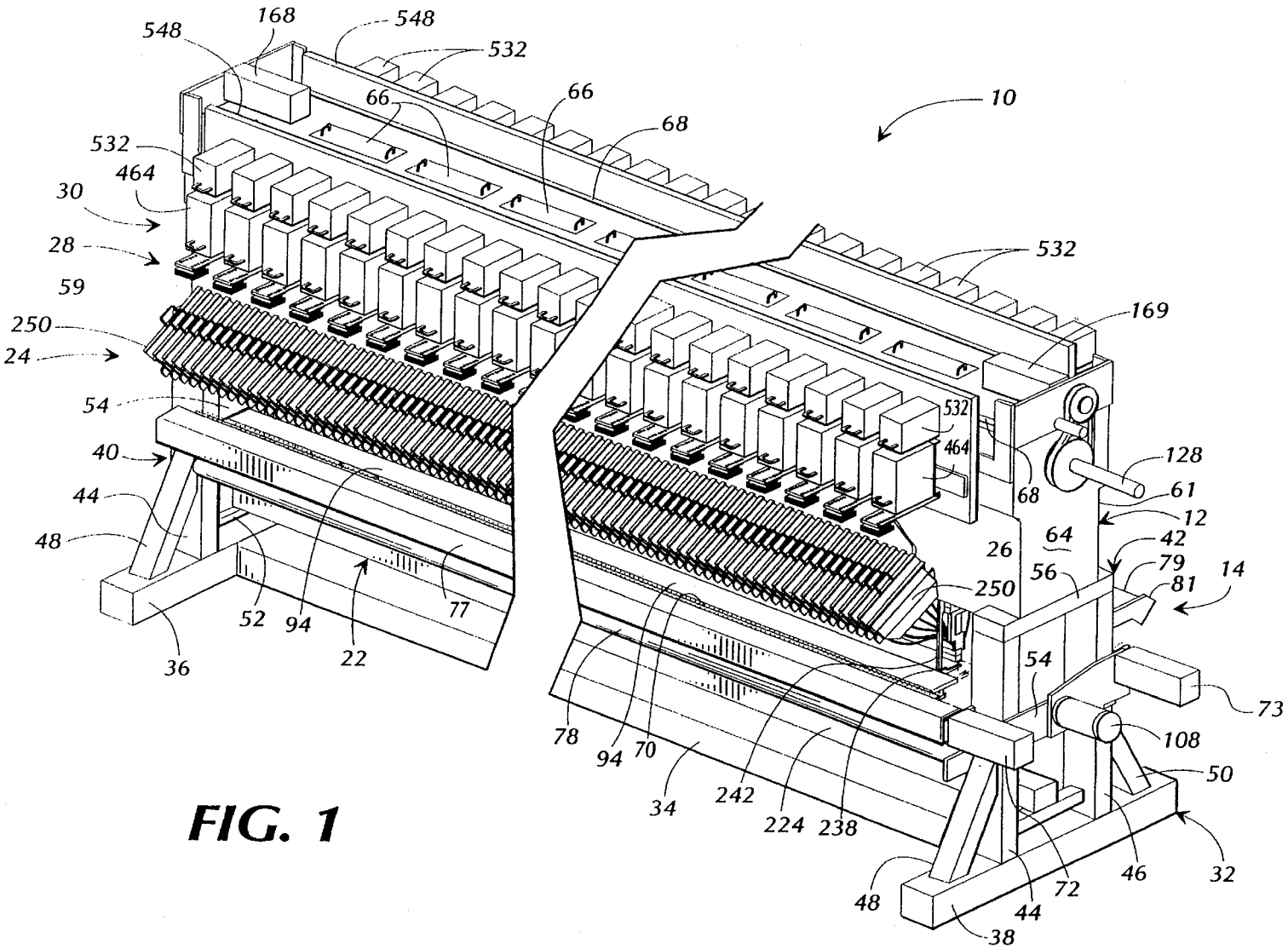
FIG. 1 is a partial perspective view of a tufting apparatus made in accordance with an embodiment of the present invention.
Figure 2A:
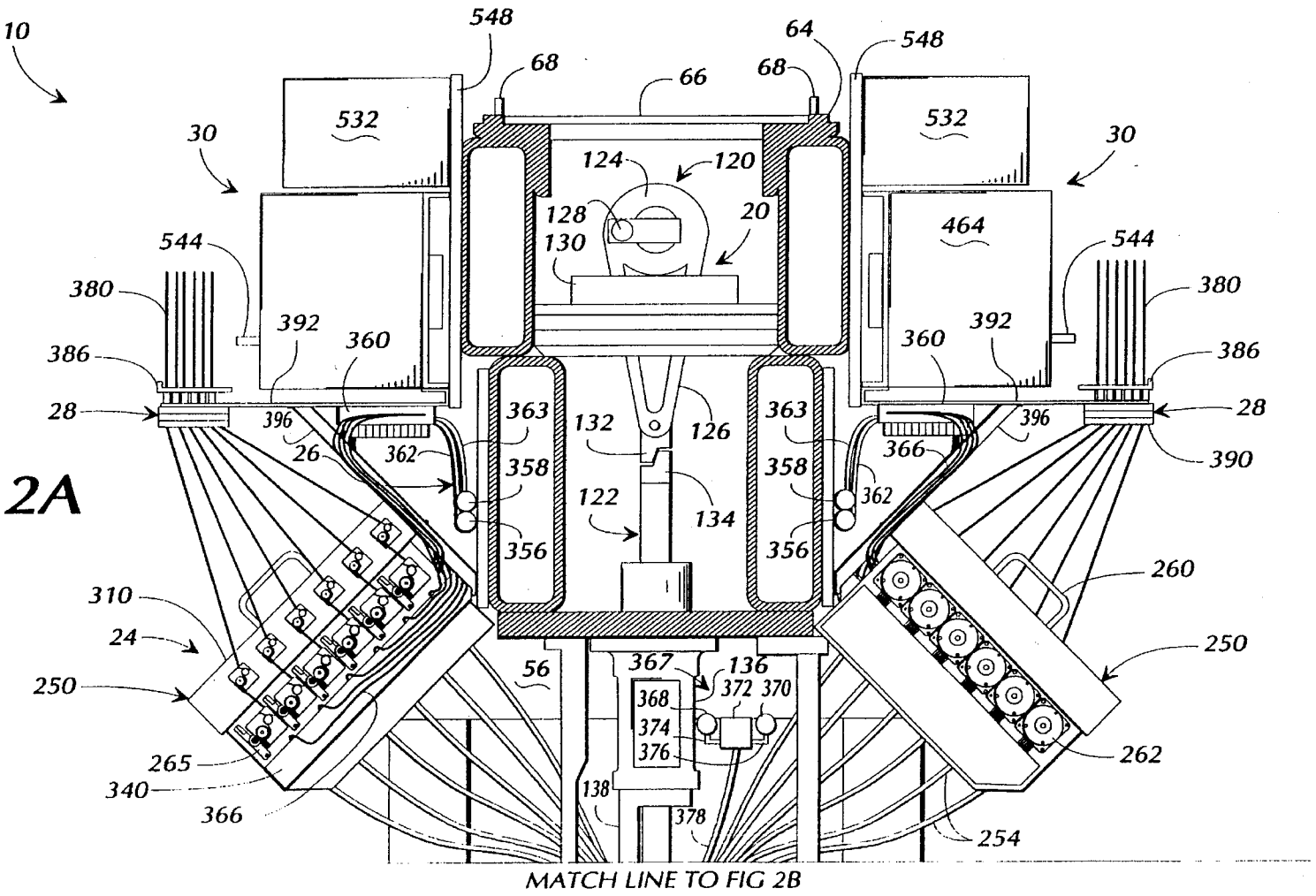
FIGS. 2A and 2B are across-sectional elevation view of the tufting apparatus shown in FIG. 1.
Figure 2B:
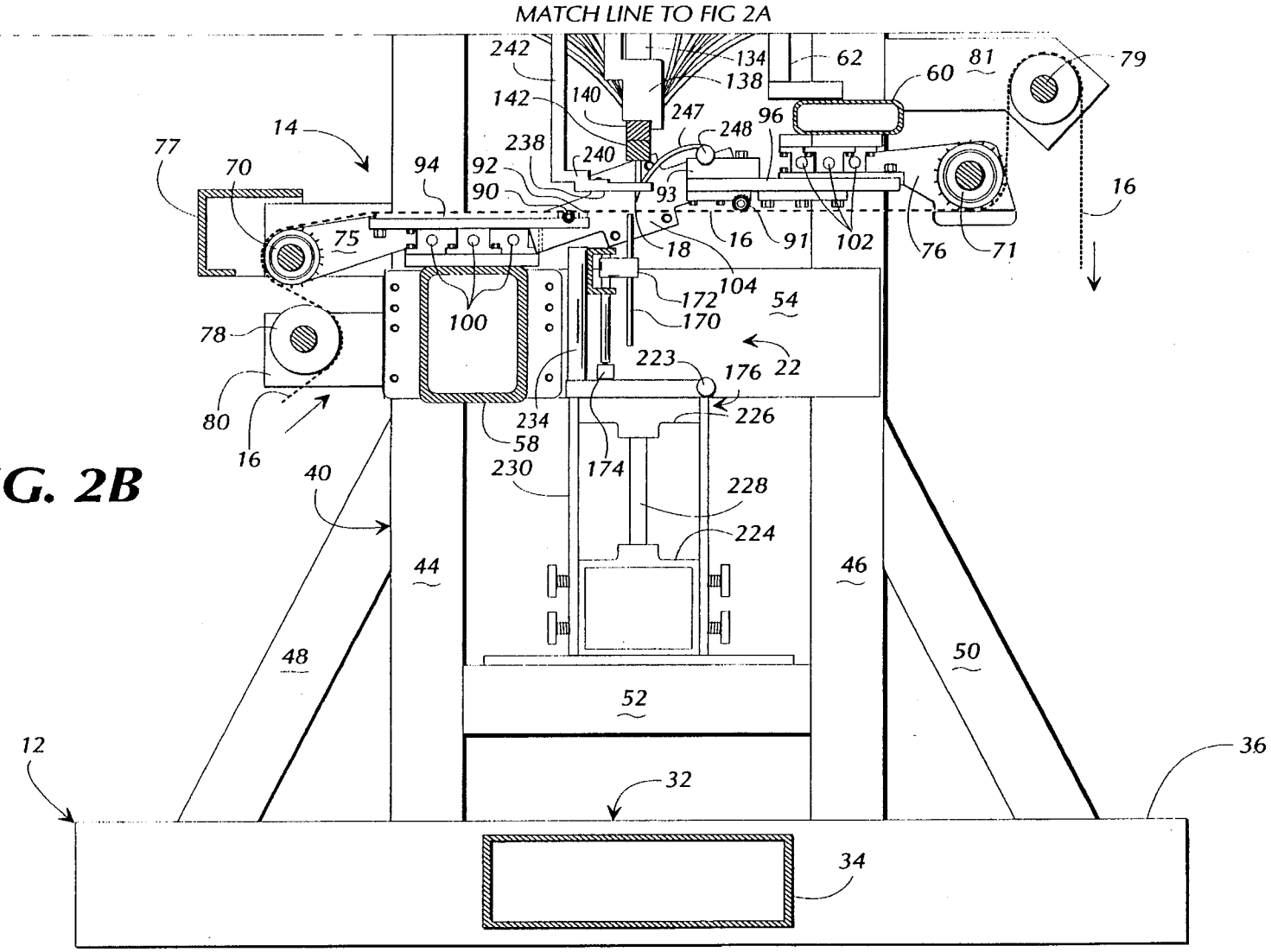

Generally described, the tufting apparatus 10, which is best shown in FIGS. 1, 2A and 2B, comprises a frame 12 supporting a backing transport system 14 for directing a backing 16 through the tufting apparatus, a row of needles 18 mounted to a needle drive system 20 for implanting tufts of yarn in the backing, a yarn cutting system 22 for cutting the yarn as it is implanted, a stationary yarn supply system 24 for supplying continuous lengths of yarn to the needles, a pneumatic supply system 26 for transporting the yarn from the stationary yarn supply system to the needles, a tube header system 28 for managing movement of the yarn from a creel to the yarn supply system, and a control system 30 for controlling the operation of the tufting apparatus so as to produce a patterned tufted product in accordance with a preselected pattern.

The term "tuft," as used herein, encompasses both cut yarn stitches and loop yarn stitches, and the term "tufting" encompasses both the act of forming a cut yarn stitch and the act of forming a loop yarn stitch.

The tufting apparatus 10 shown in FIG. 1 is the illustration of an embodiment that is 4.4m long and contains a row of 176 hollow needles 18 spaced one inch apart from center to center. That means that the backing 16 must shift transversely only one inch to complete a row of tufts. It should be understood, however, that the length of the apparatus, the spacing of the needles, and the number of needles in the apparatus can vary considerably depending on the product to be produced and the desired rate of production.

The Frame

The frame 12 of the tufting apparatus 10 is best shown in FIGS. 1, 2A, and 2B and comprises a horizontal I-shaped base frame 32 which includes an elongate member 34 extending perpendicularly between end members 36 and 38. Vertical end frames 40 and 42 extend upwardly from the end members 36 and 38. Each of the end frames 40 and 42 comprises a pair of spaced vertical members 44 and 46, angled support bars 48 and 50 extending between the vertical members and the respective end members 36 or 38. In each of the end frames 40 and 42, a cutter system frame support bar 52, a backing frame support bar 54, and an upper frame support bar 56 are spaced from one another and extend between the vertical members 36 and 38. A transverse backing support beam 58 extends between the vertical end frames 40 and 42 proximate the backing inlet side 59 of the tufting apparatus 10. Another transverse support beam 60 extends between the vertical end frames 40 and 42 at the exit side 61 of the tufting apparatus 10. A plurality of spaced vertical support bars 62 extend vertically between the transverse support beam 60 and elongate main drive housing 64. The main drive housing 64 extends between the vertical end frames 40 and 42 and is mounted on top of the upper frame support bars 56.

The interior of the main drive housing 64 is accessible through removable access panels 66 on top of the main drive housing. Guide bars 68 extend along each side of the main drive housing 64 for guiding movement of a maintenance cart (not shown) along the top of the tufting frame 12 so that the needle drive 20 can be serviced and adjusted between tufting runs.

The Backing Transport System

The backing transport system 14 transports the backing 16 through the tufting apparatus 10 while the reciprocating hollow needles 18 implant tufts of yarn in the backing. The backing may be in the form of a continuous running web. The backing 16 is moving in the direction of the arrow in FIG. 2B and the area through which the backing passes through the tufting apparatus 10 is the yarn applying region.

Figure 3:
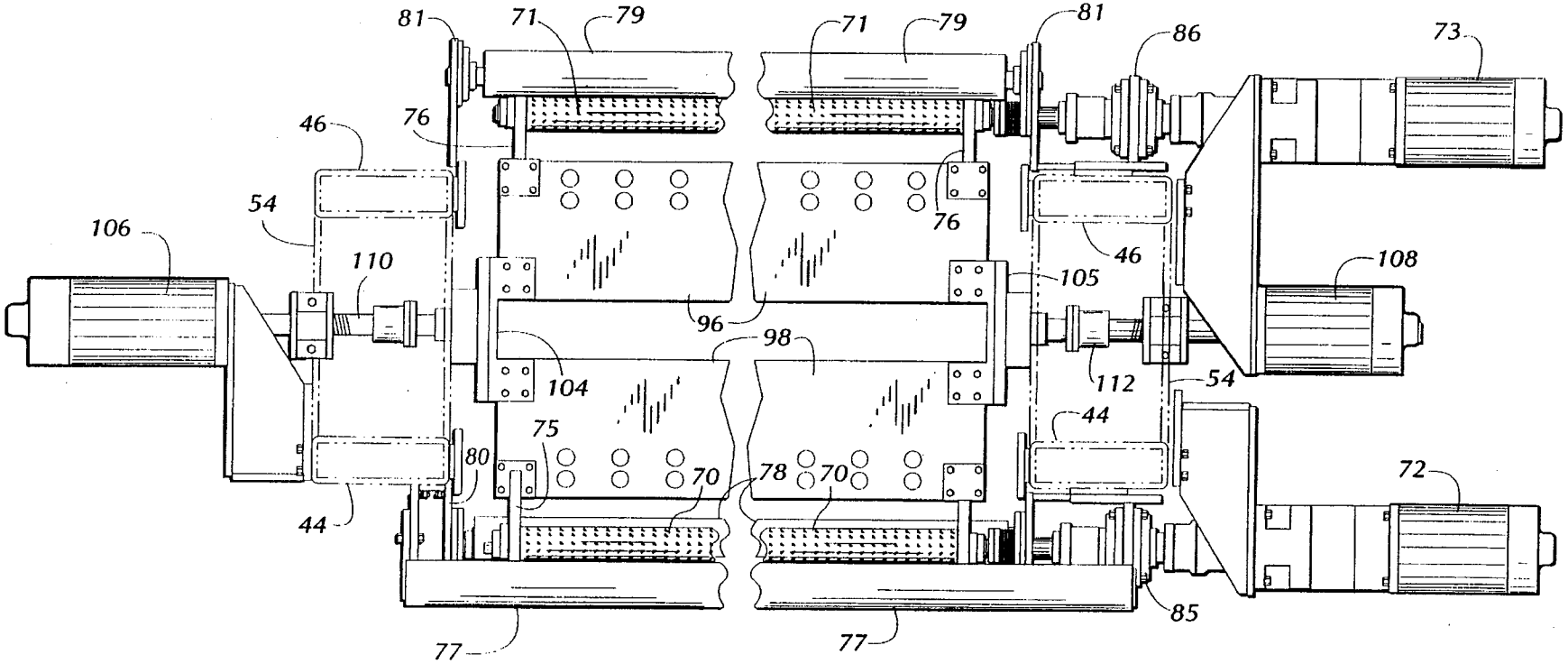
FIG. 3 is a partial plan view of the backing transport system of the tufting apparatus shown in FIG. 1.
Figure 4:
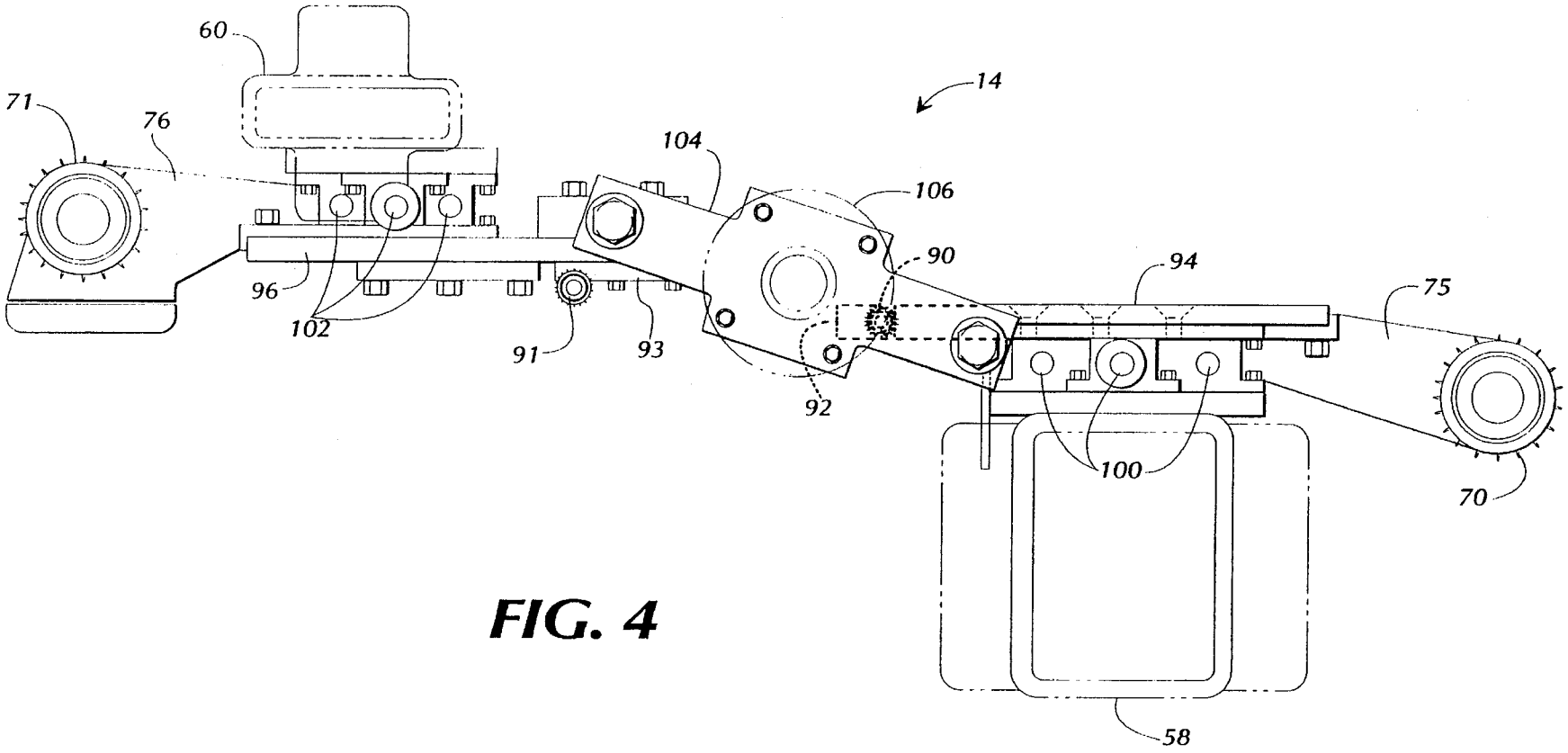
FIG. 4 is a partial cross-sectional elevation view of the backing transport system shown in FIG. 3.

As best shown in FIGS. 3 and 4, the backing transport system 14 comprises an entry pin roller 70 and an exit pin roller 71 which are driven by respective electric motors 72 and 73. The motors 72 and 73 maintain the backing 16 under tension as the backing passes the reciprocating needles 18. The exit pin roller motor 73 controls the tension of the backing 16 and the entry pin roller motor 72 controls the velocity of the backing. The pin rollers 70 and 71 are mounted to the frame 12 and extend between respective brackets 75 and 76. A guard assembly 77 is mounted to the frame 12 and extends alongside the entry pin roller 70 to shield the entry pin roller. The backing transport system 14 further comprises a pair of guide rollers 78 and 79 which cooperate with the pin rollers 70 and 71, respectively, to guide the backing 16. The guide rollers 78 and 79 are mounted to the frame 12 and extend between respective brackets 80 and 81. The pin roller motors 72 and 73 are connected to the pin rollers 70 and 71 with couplings 85 and 86.

A second pair of pin rollers 90 and 91, which have smaller diameters than the entry and exit pin rollers 70 and 71, are located closely adjacent to reciprocating needles 18 on the opposite sides of the backing 16. These additional pin rollers 90 and 91 provide better control of the backing 16 in the area adjacent to where the yarn tufts are implanted. The smaller pin rollers 90 and 91 are carried on respective brackets 92 and 93.

The backing transport system 14 further comprises a pair of bed plates 94 and 96 for supporting the backing 16 as the backing moves through the tufting apparatus 10. One of the bed plates 94 is positioned below the backing 16 and upstream of the reciprocating needles 18 between the reciprocating needles and the entry pin roller 70. The other of the bed plates 96 is positioned above the backing 16 and downstream of the reciprocating needles 18 between the reciprocating needles and the exit pin roller 71. The bed plates 94 and 96 are transversely shiftable relative to the backing advance direction.

Each of the bed plates 94 and 96 are carried on a pair of transversely extending rods 100 and 102 affixed to the frame 12. The bed plates 94 and 96 are connected at each end by respective connecting members 104 and 105. The entry and exit pin rollers 70 and 71 are preferably also carried by the shiftable bed plates 94 and 96, respectively, as indicated in FIG. 3. The connecting members 104 and 105 are connected to respective electric motors 106 and 108 with respective commercially available ball screw drives 110 and 112. The ball screw drives 110 and 112 should be capable of producing very small and precisely controlled transverse movements when rotated by the motors 106 and 108. Specifically, this precision mechanism should enable precisely controlled incremental movements of the order of one tenth of an inch or less. The motors 106 and 108 and the ball screw drives 110 and 112 shift the bed plates 94 and 96, as well as the pin rollers 70 and 71, transversely toward the longitudinal direction of advancement of the backing which produces a corresponding transverse shifting movement of the backing 16 so that each needle 18 may insert yarn into the backing at a number of transverse locations. The guide rollers 78 and 79 may also be shifted transversely in substantial correspondence with the pin rollers 70 and 71 by a second, less precise shifting mechanism.

The Needle Drive System

The needles 18 of the needle drive system 20 are reciprocated by adjustable cam assemblies 120 which are coupled to the needles by respective link assemblies 122. The adjustable cam assemblies 120 are best shown in FIG. 2A and comprise a circular cam lobe member 124 rotatably supported by bearings within a circular portion of a yoke member 126. The cam lobe members 124 are carried on and driven by a transversely extending rotatable shaft 128 which is offset from the center of each cam lobe member and preferably supported by bearings on a bearing support 130. The link assemblies 122 comprise a coupling link 132 which is pivotally connected to a yoke member 126 and connected to a vertically extending push rod 134. Each vertically extending push rod 134 extends through and is guiding for vertically reciprocal movement by bearings 136 mounted to the bottom of the main drive housing 64.

Figure 5:
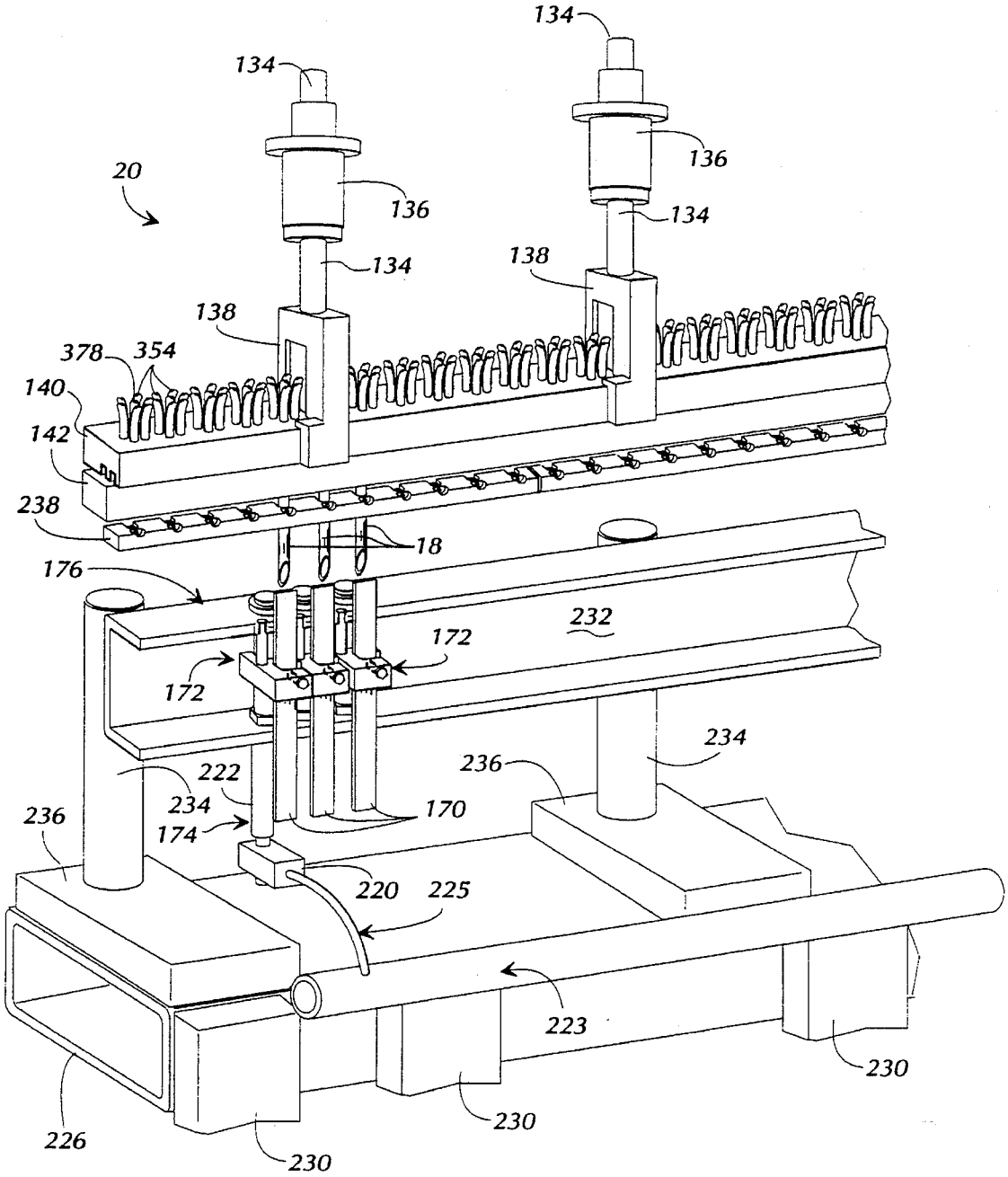
FIG. 5. is a partial perspective view of the needle drive system of the tufting apparatus shown in FIG. 1.

As best shown in FIG. 5, the lower ends of the push rods 134 are connected to respective mounting blocks 138 which are, in turn, connected to a transversely extending needle mounting bar 140. The mounting bar 140 is connected to a plurality of transversely extending funnel bars 142 which are also referred to as yarn exchangers. The needles 18 are mounted to the funnel bars 142. In FIG. 5, only three needles 18 are illustrated, but it should be understood that there is a needle 18 associated with each set of yarn passages 146 along the length of the needle mounting bar 140. Upon rotation of the shaft 128, the adjustable cam assemblies 120 rotate to impart a reciprocating movement to the yoke members 126 and, in turn, a similar movement to the needles 18 via the link assemblies 122 to cause the needles to repetitively penetrate and withdraw from the backing 16.

Figure 6:
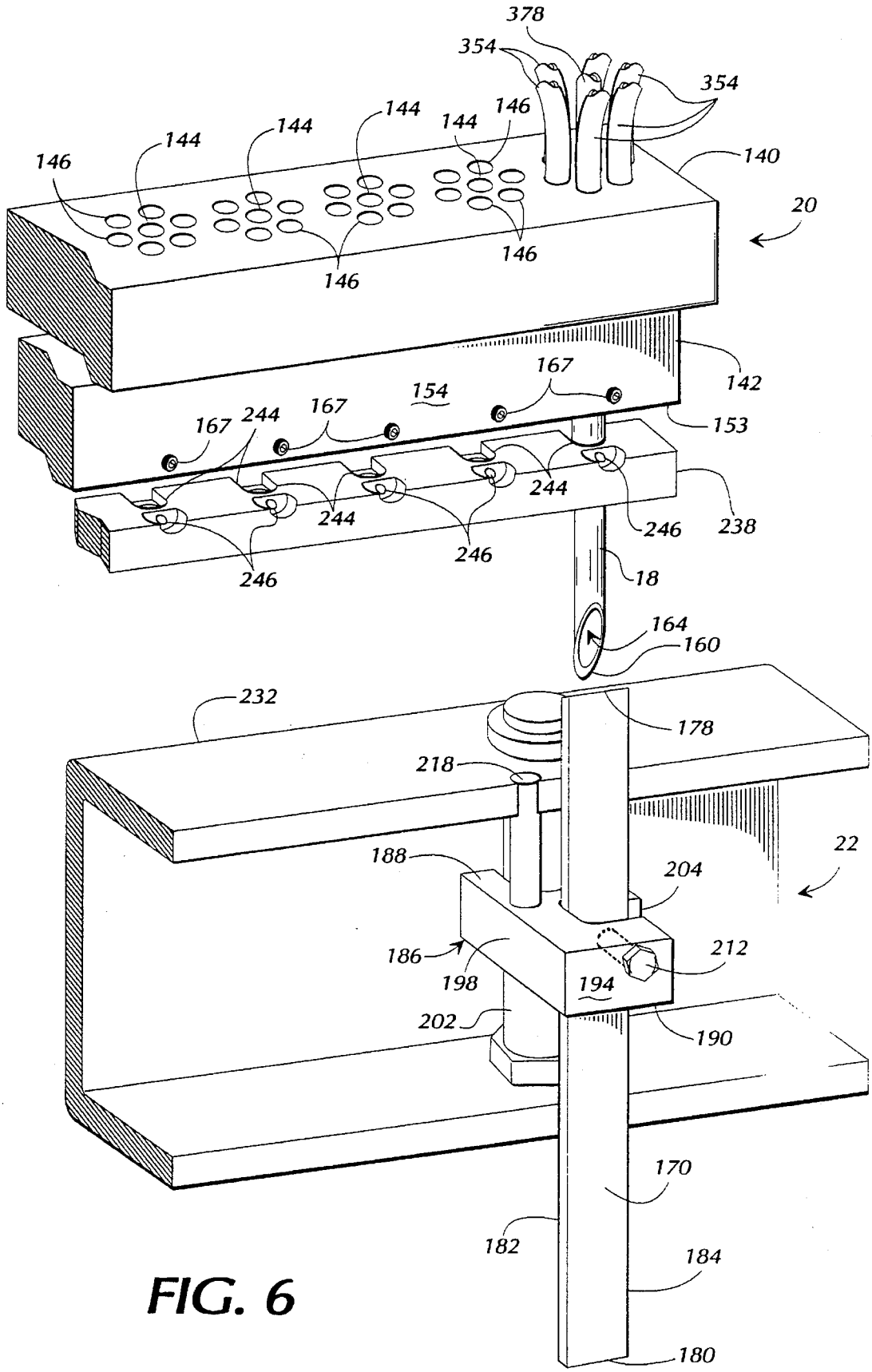
FIG. 6 is a partial perspective view of the needle drive system, cutter system, and presser foot of the tufting apparatus shown in FIG. 1.

As shown in FIGS. 5 and 6, the needle mounting bar 140 is rectangular in cross-section, and for each needle 18, has a central passage 144 extending from an inlet at the top of the mounting bar to an outlet at the bottom of the mounting bar and a plurality of yarn passages 146 surrounding each central passage 144 and extending from respective inlets in the top of the mounting bar to respective outlets in the bottom of the mounting bar.

Figure 7:
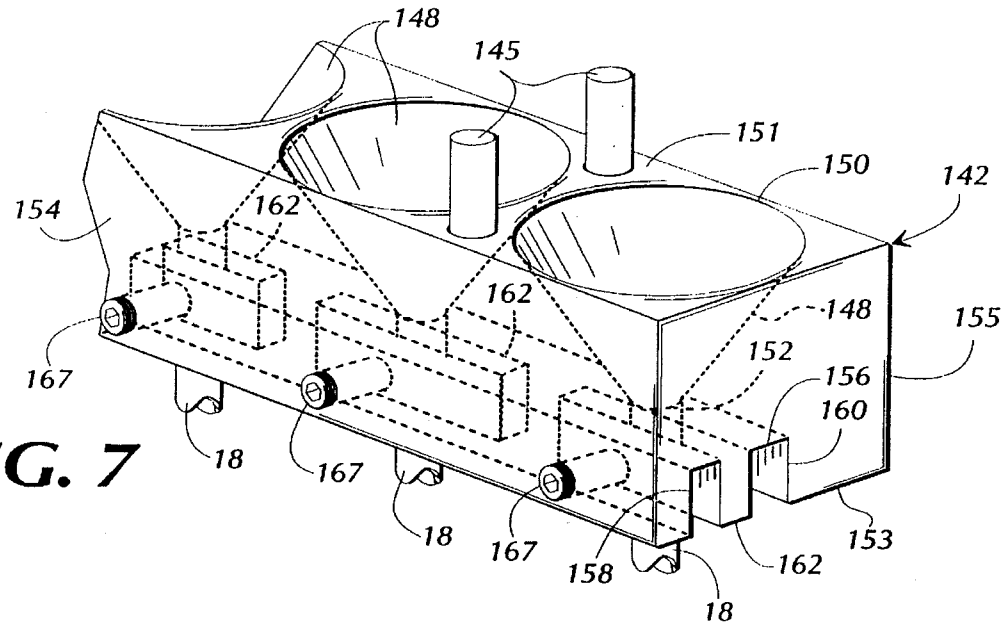
FIG. 7 is a partial perspective view of a funnel bar which is part of the needle drive system of the tufting apparatus shown in FIG. 1.
Figure 9:
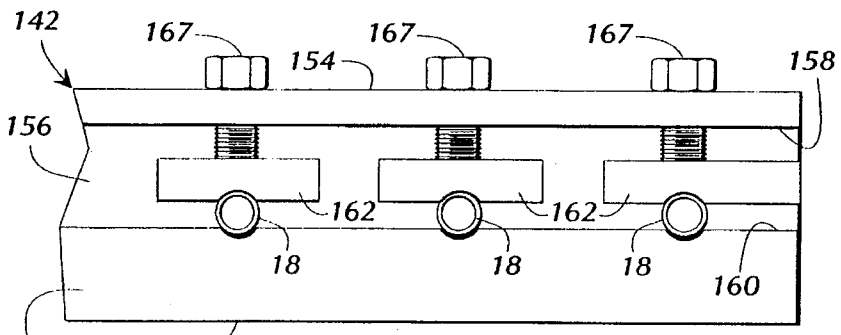
FIG. 9 is a partial plan view of the underside of the funnel bar shown in FIG. 7 illustrating the needle mount.
Figure 8:
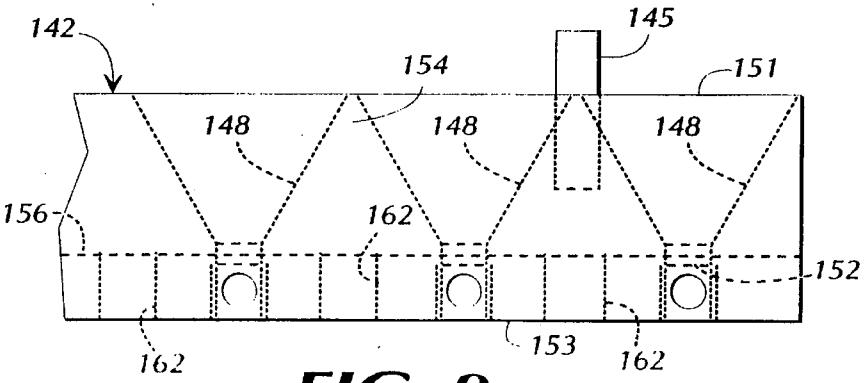
FIG. 8 is a partial elevation view of the funnel bar shown in FIG. 7.
Figure 10:
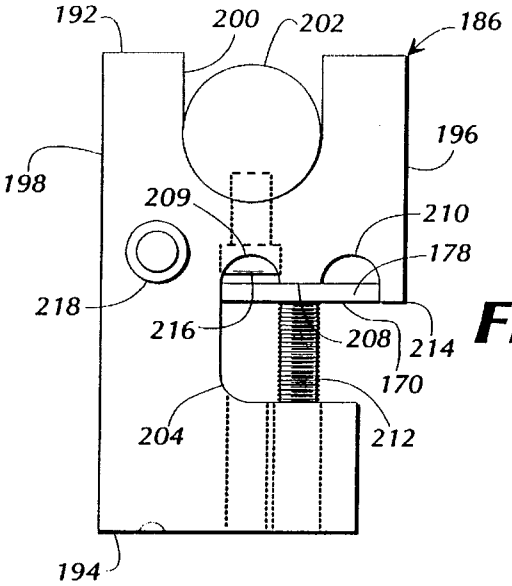
FIG. 10 is a plan view of a cutting blade and a cutting blade holder which is part of the cutting system of the tufting apparatus shown in FIG. 1.

The funnel bars 142 are mounted to the bottom of the needle mounting bar 140 along the length of the needle mounting bar with bolts (not shown) and are aligned with the needle mounting bar with press fitted dowel pins 145. As illustrated in FIGS. 7 and 8, the funnel bars 142 have a plurality of funnels 148 corresponding to each needle 18 and extending from an inlet 150 at the top 151 of the funnel bar to an outlet 152 at the bottom 153 of the funnel bar. Each funnel bar 142 has elongated sides 154 and 155 extending between the top 151 and bottom 153. As shown in FIGS. 7 and 9, an elongate channel 156 having a rectangular cross-section extends lengthwise along the bottom 153 of each funnel bar 142 such that the outlets 152 of the funnels 148 open into the channel 156. The channel 156 has opposing sidewalls 158 and 160 and a plurality of spaced protrusions or plates 162 extending from the funnel bar 142 between the opposing walls. The protrusions 162 are spaced from one another along the length of the channel 156 and the needles 18 are disposed between respective protrusions 162 and the inner wall 160 of the channel 156.

The needles 18 each have a hollow passage extending from an inlet to an outlet 164 at a pointed tip 166. The structure of the needles is disclosed in more detail in U.S. Pat. No. 4,991,523, the disclosure of which is expressly disclosed herein by reference. Each needle 18 is disposed in the channel 156 such that the inlet of the needle is in communication with the outlet 152 of the respective funnel 148. As shown in FIG. 9, each needle 18 is clamped and fixed to the funnel bars 142 by respective set screws 168 which extend through a side 154 of the funnel bar through the channel 156 and against the respective protrusions 162.

The set screws 167 are tightened to force the protrusions 162 against the needles and fix the needles to the funnel bars 142. The needles 18 can be removed and replaced or sharpened by loosening the set screws 167 and releasing the protrusions 162 from against the needles.

The needle drive system 20 is driven by electric motors 168 and 169 operatively connected to opposite ends of the main drive shaft 128 and mounted to opposite ends of the main drive housing 64 for rotating the main drive shaft. The main drive motors 168 and 169 are shown in FIG. 1. For high product throughput, the main drive motors 168 and 169 should rotate the main drive shaft 128 at speeds up to about 1000 rpm.

Each rotation of the main drive shaft 128 causes the needles 18 to penetrate and then withdraw from the backing 16. In other words, each rotation of the main drive shaft 128 causes one needle reciprocation cycle, also referred to as a tufting cycle, which includes a downstroke and an upstroke of the needles 18.

The Yarn Cutting System

As best shown in FIGS. 5 and 6, the yarn cutting system 22 is positioned below the backing transport system 14 and comprises a plurality of knife blades 170, one positioned below each of the needles 18 for cutting the yarn implanted into the backing 1 6 by the needle at the downstroke of each tufting cycle. The knife plates 170 are arranged to cooperate with the needles 18 by sliding over the respective angled tips 166 of the needles 18 in a shearing-like action to cut the yarn that is ejected from the needles. The yarn cutting system 22 further comprises a blade holder 172, a mechanism 174 for reciprocating the knife blade 170, and a frame 176 for supporting the knife blade, blade holder, and reciprocating mechanism.

The knife blade 170 comprises a flat elongated strip of metal, such as steel, having a cutting edge 178 which shears the yarn, a bottom edge 180, and longitudinal edges 182 and 184 extending between the cutting edge and the bottom edge.

The knife blade holder 172 comprises a blade holder block 186 having a top 188, a bottom 190, a rear 192, a front face 194, and sides 196 and 198 extending between the front face and the rear. A C-bore 200 extends from the top 188 to the bottom 190 of the block 186 at the rear 192 of the block and receives a reciprocable shaft 202 on which the block reciprocates. The block 186 further has a passage 204 extending from the top 188 to the bottom 190 of the block between the C-bore 200 and the front face 194 of the block. The passage 204 is open to one side 196 of the block 186 so that the passage is accessible from the side. A protrusion 206 having a flat face 208 projects from the block 186 within the passage 204 and extends from the top 188 to the bottom 190 of the block. The protrusion 206 projects towards the front face 194 of the block. The protrusion 206 forms two U-shaped recesses 209 and 210 behind the flat face 208. The blade 170 is disposed in the passage 204 and fits flush against the flat face 208 of the projection such that the cutting edge 178 extends above the top 188 of the block 186 and the bottom edge 180 extends below the bottom 190 of the block.

A set screw 212 extends through the front face 194 of the block 186 and can be tightened so as to force the blade 170 tightly against the flat face 208 of the protrusion 206 to securely mount the blade in the holder 172. The set screw 212 can be loosened to release the blade 170 for sharpening or replacement. A portion 214 of the block 186 extends along the side 196 of the block 186 beyond the flat face 208 of the protrusion 206 to hold the blade 170 securely within the passage 204 and prevent the blade from sliding out of the passage beyond the side of the block. Another set screw 216 extends through the front face 194 of the block 186 and into the shaft 202 to mount the block 186 to the shaft. A dowel pin 218 extends from the top 188 of the block 186 and slidingly engages the cutting system frame 176 to prevent rotation of the blade 170 and blade holder 172.

The reciprocation mechanism 174 for each blade 170 comprises an air cylinder 222 for driving the shaft 202 in a vertical reciprocating motion and a solenoid 220 for activating the air cylinder. A pressurized air supply pipe 223 for supplying air to the air cylinder 222 is shown in FIG. 5 and forms part of the pneumatic supply system 26. Tubes 225 (shown in FIG. 5) deliver pressurized air from the air supply pipe 223 to the air cylinders 222. A control system for the yarn cutting system 22 is described further hereinbelow.

The cutting system frame 176 comprises a lower transverse beam 224 which extends across the frame 12 of the tufting apparatus 10 and is mounted on the cutter system frame support bars 52 of the respective end frames 40 and 42. An upper transverse beam 226 is spaced above and extends parallel to the lower transverse beam 224 and can be raised and lowered respective to the lower beam with a plurality of spaced jacks 228 extending between the lower beam and the upper beam. A plurality of adjustable height bars 230 extend between the lower beam 224 and the upper beam 226 and provide additional support for the upper beam. A transversely extending C-bar 232 is spaced above and extends parallel to the upper beam 226 is mounted to the upper beam by a plurality of bars 234 spaced from one another and mounted to corresponding blocks 236 fixed to the upper beam 226.

The Presser Feet

To prevent the needles 18 from raising the backing 16 when the needles are removed from the backing during the upstroke of the needle drive system 20, a plurality of presser feet 238 are disposed adjacent the needles transversely across the tufting apparatus 10 and slightly above the backing. The presser feet 238 are connected to an elongated rail member 240, shown in FIG. 2B, with means such as screws. The rail member 240 is connected to the underside of the main drive housing 64 with arms 242 to fix the presser feet to the tufting apparatus frame 12.

Figure 11:
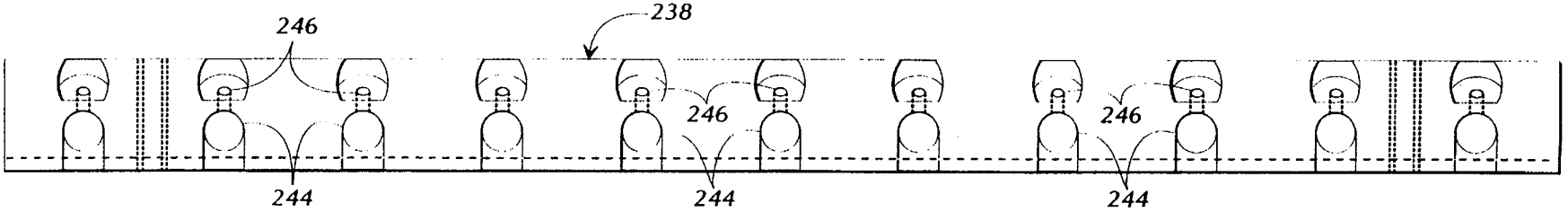
FIG. 11 is a plan view of a section of the presser foot of the tufting apparatus shown in FIG. 1.

As illustrated in FIGS. 6 and 11, each of the presser feet 238 extend below the needles 18 and have a plurality of bores 244 corresponding to each needle and through which the respective needles may reciprocate freely. Air conduits 246 communicate with each of the needle bores 244. Pressurized air is blown through the conduits 246 by corresponding tubes 247 connected to a pressurized air pipe 248 which forms part of the pneumatic supply system 26.

Pressurized air is directed through the conduits 246 and into the needle bores 244 as the needles 18 are withdrawn from the backing 16. This air forces the severed limb of yarn, which is the limb forming the last backstitch and which is no longer connected to the needle, down into the opening in the backing before the needle makes a subsequent opening. This eliminates the excess yarn on the rear of the backing and precludes the yarn from forming a backstitch raised above the surface of the backing material. Each air conduit 246 is desirably disposed at an angle of about 45° relative to the axis of the respective needle 18. The presser feet 238 are similar to those disclosed in U.S. Pat. No. 5,158,027, the disclosure of which is expressly incorporated herein by reference.

The Yarn Supply System

The yarn supply system 24 supplies a plurality of different yarns to each needle 18 of the tufting apparatus 10. The yarns are desirably of a different color so that the tufting apparatus 10 can be used to make multicolor patterned tufted goods such as carpet. In the embodiment shown in FIG. 1, the tufting apparatus has 176 needles spaced one inch apart but, as explained hereinabove, could comprise more or less needles with more or less spacing depending on the product to be produced and the level of throughput desired. The yarn supply system 24 of the tufting apparatus 10 is capable of selecting, for any given needle 18, on any given needle reciprocation cycle, one of the six different yarns and delivering the desired length of that yarn to the respective needle. In addition, the yarn supply system 24 is capable of simultaneously withdrawing one yarn from a needle 18 and inserting another yarn into that needle in the same needle reciprocation cycle.

In the embodiment shown in FIG. 1, the yarn supply system 24 comprises 176 yarn supply modules 250 (only some of which are illustrated) one for each needle 18. Each yarn supply module 250 is capable of selectively delivering substantially exact lengths of any one of six different yarns to the respective needle. One-half of the yarn supply modules are mounted to one side of the tufting apparatus 10 and the other half of the yarn supply modules are mounted to the other side of the tufting apparatus. Thus, the yarn supply modules 250 are spaced two inches apart from center to center. The yarn supply modules 250 are positioned substantially perpendicularly to the length or the longitudinal axis of the tufting frame 12. Each of the yarn supply modules 250 is selectively movable from an operating position adjacent the tufting frame 12 and a maintenance position spaced from the tufting frame.

The yarn supply modules 250 each comprise a yarn supply frame 252 which includes a motor mounting panel 254 having a pair of L-shaped mounting slots 256 in the lower portion of the motor mounting panel and a C-shaped yarn movement sensor mounting bar 258 fixed to the upper portion of the motor mounting panel. A handle 260 is mounted to the top 261 of the yarn movement sensor mounting bar 258 for manually shifting the module from the operating position to the maintenance position.

Figure 12:
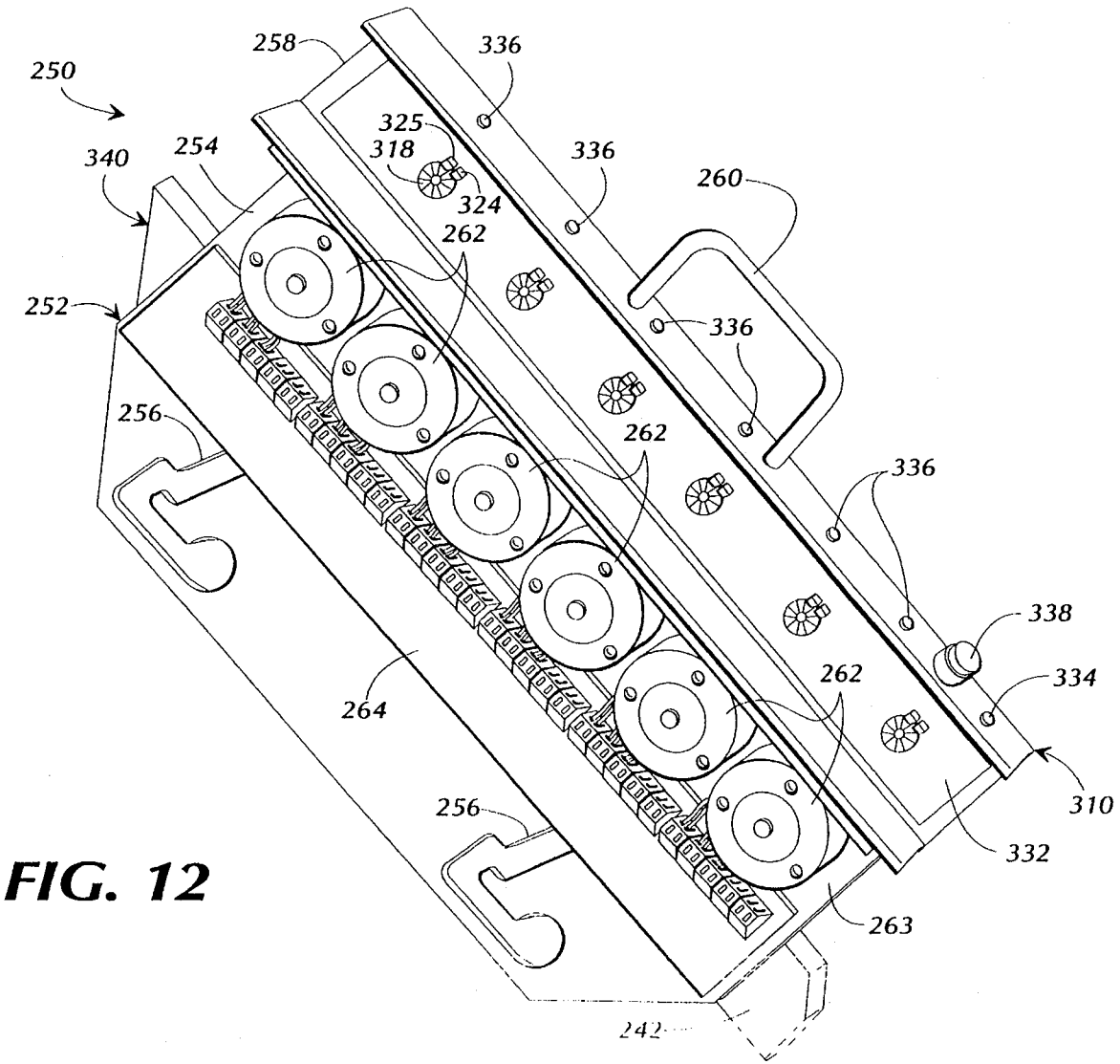
FIG. 12 is perspective view of the motor side of a yarn supply module of the tufting apparatus shown in FIG. 1.

As best shown in FIG. 12, each yarn supply module 250 comprises six electric stepper motors 262 mounted to the motor mounting panel 254 of the yarn supply frame 252 and in parallel to one another. Each yarn supply module 250 has a longitudinal axis extending substantially perpendicularly to the longitudinal axis of the tufting frame 12 which extends substantially transversely to the direction of the advancement of the backing material 16. The stepper motors 262 have respective axis of rotation substantially perpendicular to the longitudinal axes of the respective yarn supply module 250. Each of the stepper motors 262 is capable of supplying a predetermined length of yarn to the respective needle 18 and selectively advancing the predetermined length of yarn to the needle, and alternatively, holding the yarn or retracting the yarn from the needle.

Desirably, the stepper motor 262 is one with a low rotor inertia, low mass, good acceleration and power at high speed such as an ESCAP P532 stepper motor available from Portescap of La Chaux-de-Fonds, Switzerland. Such stepper motors comprise a rotor including a rare earth disk magnet which provides low rotor inertia. Desirably, the rotor inertia is from about 11 $kmg^2 \times 10^{-7}$ to about 13 $kgm^2 \times 10^{-7}$. A most desirable stepper motor is the ESCAP P532-258 0.7 stepper motor available from Portescap. Such a motor has a low inertia, extended pull-in range, high peak speed and boost torque capability for fast incremental motion. The stepper motors are operated in half step mode, can advance yarn at a speed up to about 2 inches per 30 milliseconds, and advance, hold, or retract yarn with a minimum force of 20 ounces. Wiring for the stepper motors 262 is mounted to a board 264 connected to the motor side 263 of the motor mounting panel 254.

Figure 13:
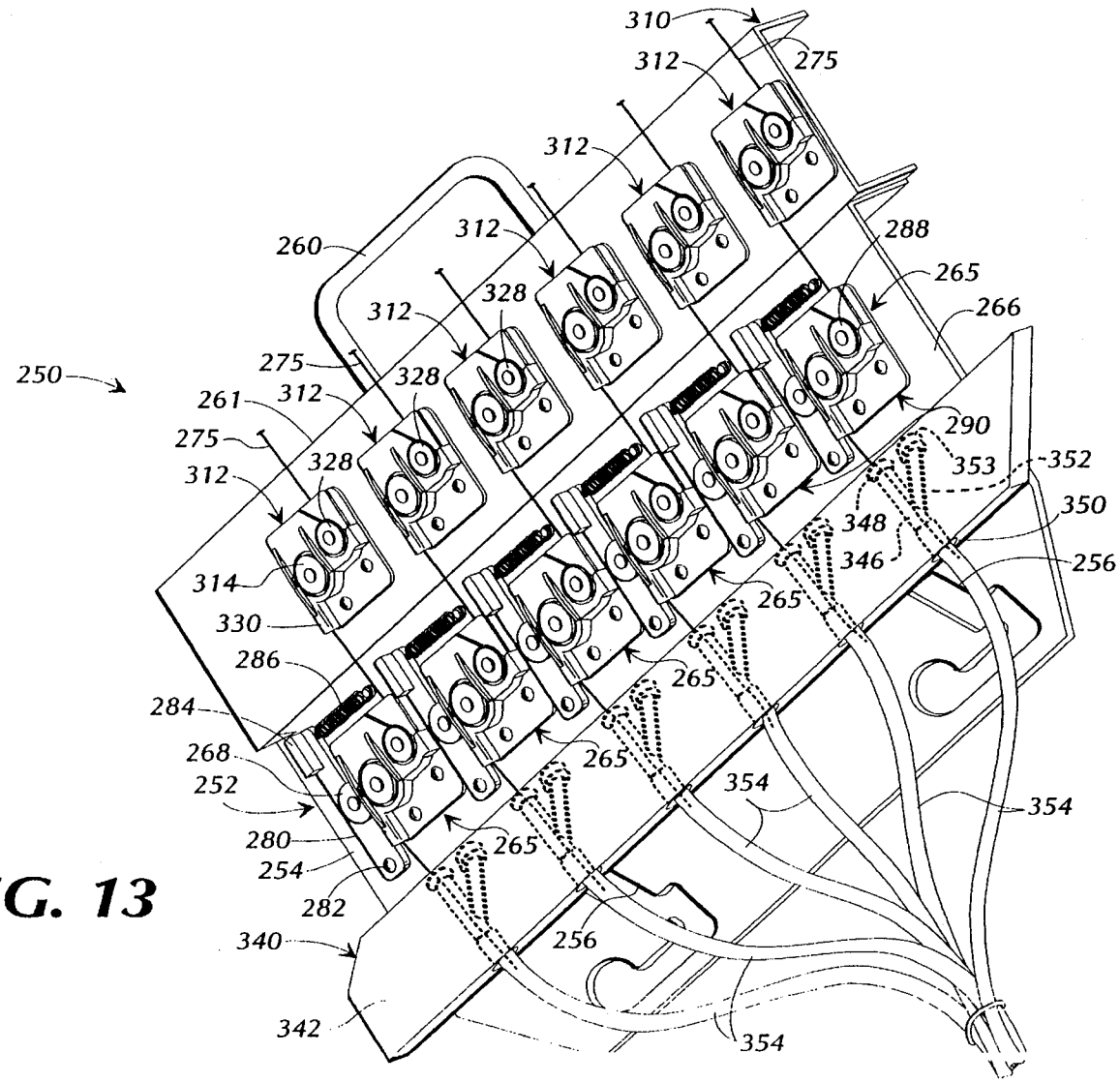
FIG. 13 is a perspective view of the yarn side of the yarn supply module shown in FIG. 12.
Figure 14:
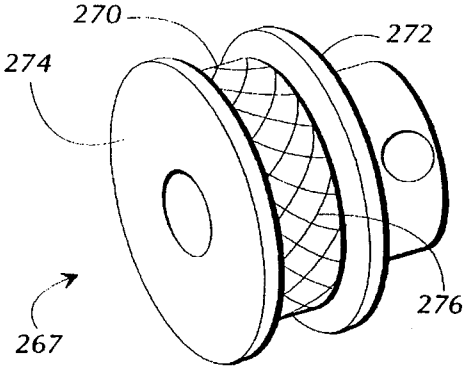
FIG. 14 is a perspective view of a capstan which forms part of the yarn supply module shown in FIG. 12.

Each stepper motor 262 is operatively associated with a yarn drive mechanism 265 attached to the yarn side 266 of the motor mounting panel 254 and best shown in FIG. 13. Each yarn drive mechanism 265 comprises a capstan 267, rotatably connected to the respective stepper motor 262 through a shaft (not shown) and a pinch roller 268. The capstan 267 is best shown in FIG. 14. The stepper motor 262 rotates the capstan 267 and yarn is drawn through the nip between the pinch roller 268 and the capstan 267. The capstan comprises a barrel 270 extending between an inner flange 272 and outer flange 274. The barrel 270 has a knurled surface 276 for gripping the yarn that passes through the nip between the capstan and pinch roller 268.

The outer layer of the pinch roller 268 comprises a material such as hard rubber or plastic. The pinch roller 268 is rotatably mounted to a pinch bar 280 which is pivotally connected to the motor mounting panel 254 at pivot 282 and has a handle 284 at the other end. A spring 286 extends from the pinch bar 280 proximate the handle 284 to the motor mounting panel 254 so that the pinch roller 268 is biased the capstan barrel 270. The pinch roller 268 is then selectively movable between an engaged position, wherein the pinch roller fits between the flanges 272 and 274 of the capstan 267 and forms a nip between the capstan barrel 270 and the pinch roller, and a disengaged position, wherein the pinch roller is spaced from the capstan and the yarn can be placed in or removed from the nip between the capstan barrel and pinch roller. The pinch roller 268 is shiftable between the engaged and disengaged positions manually by grasping the handle 284 and pulling the pinch bar 280 against the spring 286. In FIG. 13, the passage of yarns 275 through the yarn supply module 250 is illustrated.

The yarn drive mechanism 265 further comprises a fixed post 288 mounted to the motor mounting panel 254 of the yarn supply frame 252 so that the capstan 267 is between the pinch roller 268 and the post such that when the pinch roller is in the engaged position and the respective stepper motor rotates the capstan 267, the yarn can be drawn around the post over a portion of the capstan barrel 270, and through the nip between the capstan barrel and pinch roller 268. Desirably, the post 288, capstan 267, and pinch roller 268 are arranged so that when the yarn is drawn over the capstan, the portion of the capstan contacted by the yarn extends from about 165° to about 190° about the capstan barrel 270. Most desirably, the yarn extends about 180° about the capstan barrel 270.

Each yarn drive mechanism 265 further comprises a guide plate 290 mounted to the motor mounting panel 254 of the yarn supply frame 252 and having openings 291 and 292 for receiving the capstan 267 and post 288, respectively. The guide plate constrains the yarn as the yarn is drawn around the post 288, over the capstan barrel 270, and through the nip between the capstan barrel and pinch roller 268.

Figure 15:
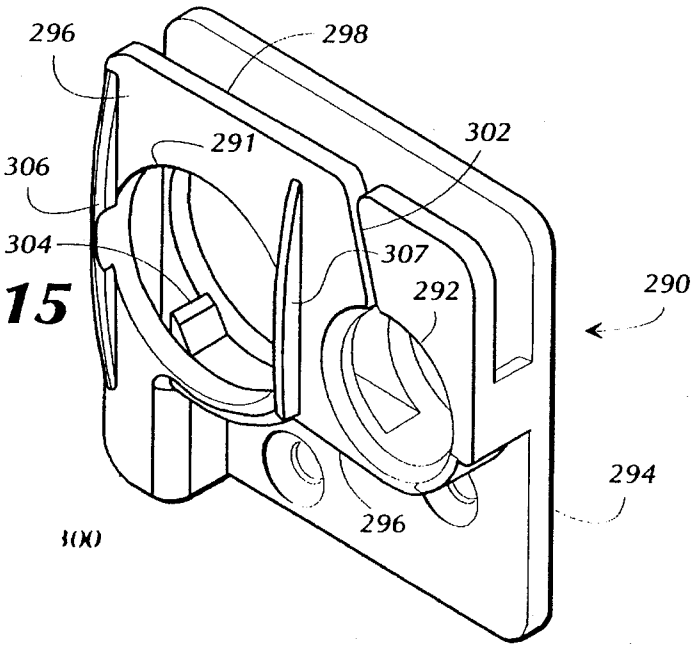
FIG. 15 is a perspective view of a yarn guide plate which forms part of the yarn supply module shown in FIG. 12.

The guide plate 290 is illustrated in FIG. 15 and comprises a mounting plate 294, which is mounted to the motor mounting plate 254, and a cover plate 296 extending from the mounting plate 294, underneath the post 288 and capstan 267, around the post and capstan to an upper edge 298. The cover plate 296 is spaced from the yarn supply frame 252 and the mounting plate 294 so that there is a gap between the mounting plate and the cover plate and yarn can be drawn between the cover plate and the yarn supply frame 252 or mounting plate and through the yarn drive mechanism 265. The cover plate 296 also forms a yarn exit passage 300 for the yarn that exits from the nip between the capstan 267 and pinch roller 268. A slot 302 extends from the post opening 292 and the cover plate 296 to the upper edge 298 so that yarn can be fed manually through the slot and about the post 288.

Furthermore, each yarn guide plate 290 includes a finger 304, proximate the nip between the pinch roller 268 and the capstan 267, for guiding yarn away from the capstan after the yarn exits the nip. In addition, ribs 306 and 307 protrude outwardly from the cover plate 296 of the guide plate 290 on each side of the capstan opening 291 to provide spacing between adjacent yarn supply modules 250.

Each yarn supply module 250 comprises a yarn sensing module 310 for providing the operator of the tufting apparatus 10 information on the movement/non- movement of each yarn supplied by the yarn module. As best shown in FIGS. 12 and 13, each yarn supply module 250 has six stepper motors 262 for controlling six different yarns and a yarn sensing mechanism 312 for each stepper motor. The yarn sensing module 310 includes the yarn sensing mounting frame 258 and each of the yarn sensing mechanisms 312. The purpose of the yarn sensing module 310 is to provide closed loop feedback of the movements of each yarn. That is, after a particular stepper motor 262 has been given the appropriate commands to move the yarn, the yarn sensing module 310 verifies to the operator of the tufting apparatus that the yarn associated with that stepper motor actually moved.

Figure 16:
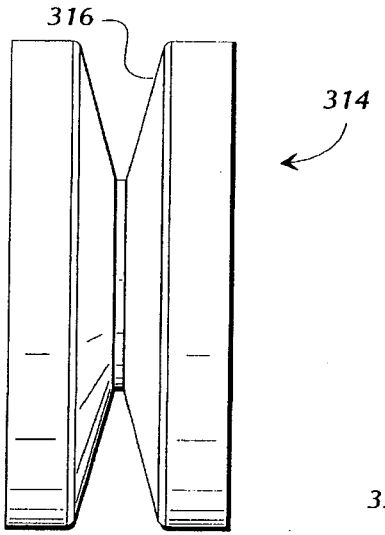
FIG. 16 is an elevation view of a yarn movement sensor drive wheel which forms part of the yarn supply module shown in FIG. 12.

Yarn movement through each yarn sensing mechanism 3 12 is sensed optically. Each yarn sensing mechanism 312 comprises a wheel 314 mounted to the yarn sensing mounting frame 258. Each wheel 314 has a peripheral V-shaped channel 316 for receiving one of the yarns as shown in FIG. 16. The wheel 314 is rotatably connected to a slotted disk 318 via a shaft (not shown) extending through the yarn sensing mounting frame 258. The wheel 314 extends outwardly from the yarn side 266 of the yarn supply frame 252 and the slotted disk 318 extends outwardly from the motor side 263 of the yarn supply frame.

Figure 17:
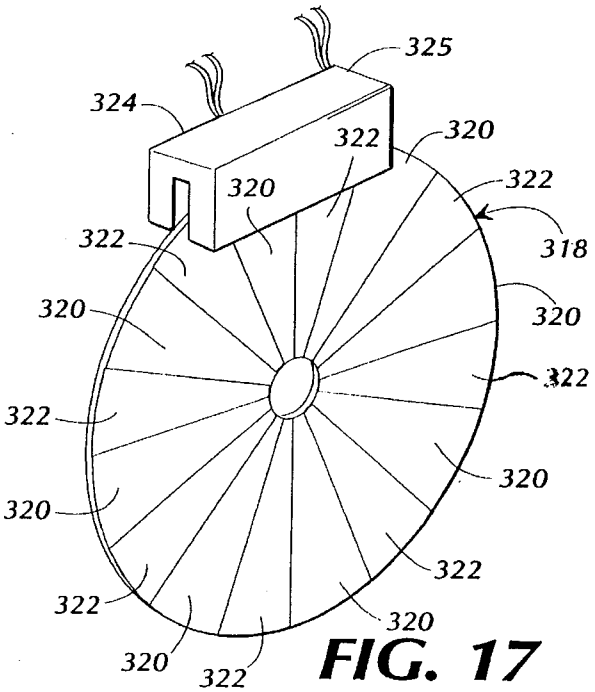
FIG. 17 is a partial perspective view of a yarn movement sensor which forms part of the yarn supply module shown in FIG. 12.

When driven by the associated stepper motor 262, yarn passes over a portion of the wheel 314 in the V-shaped peripheral channel 316 and rotates the wheel which, in turn, rotates the slotted disk 318. As best shown in FIG. 17, the slotted disk 318 comprises radially extending sections of alternating phototransmission capability. Specifically, the slotted disk 318 shown in FIG. 17 comprises alternating radially extending sections of transparent material 320 and opaque material 322. LED/photo transistors 324 and 325 (sensors) are disposed on opposite sides of the slotted disk 318 for detecting movement of the slotted disk.

Movement of the slotted disk 318 is defined as the transition from no-light to light or light to no-light. When the associated yarn moves, the slotted disk 3 18 moves thereby interrupting the light between the LED/phototransistor pairs 324 and 325. The phototransistors are "on" allowing current flow, when light is incident to the phototransistor, and "off", allowing no current flow when light is not incident to the phototransistor. Thus, as the slotted disk 318 moves, the output of the phototransistors 324 and 325 are switching "on-off", indicating yarn movement. If there is no switching of the phototransistors 324 and 325 when the associated stepper motor 262 has been given the appropriate commands, then there is no yarn movement and an error condition exists. Typical error conditions are broken yarn and jammed yarn resulting from knots in the yarn or jammed yarn spools. There are two phototransistors 324 and 325 for each slotted disk 318 so that the direction of movement of the slotted disk, and thus the yarn, can be detected, and vibration of the slotted disk can be distinguished from rotation of the disk due to yarn movement.

Each yarn sensing mechanism 312 further comprises a post 328 and a yarn guide plate 330, both having the same structure and function as the post 288 and yarn guide plate 290 associated with each yarn drive mechanism 265.

Figure 18:
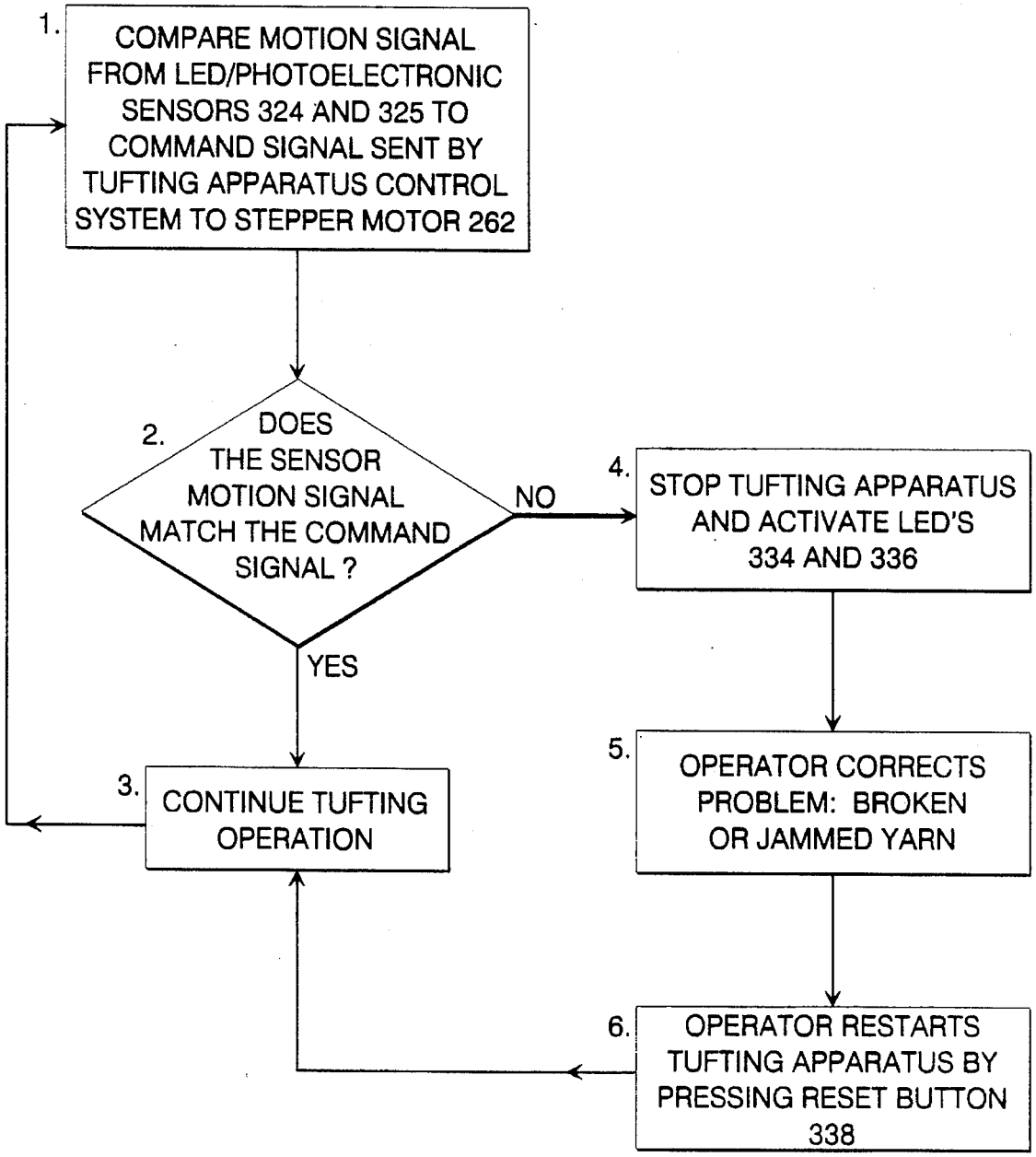
FIG. 18 is a schematic diagram of the logic used in monitoring the yarn movement with the yarn sensing system of the tufting apparatus shown in FIG. 1.

Each yarn sensing mechanism 312 comprises associated electronics mounted to a circuit board 332 connected to the yarn sensing frame 258. The logic function performed by the yarn sensing electronics is diagrammed in FIG. 18. As can be seen from this diagram, in block 1, the yarn sensing electronics first compare a motion signal from the LED/photoelectronic sensors 324 and 325 to a command signal sent by the tufting apparatus control system to the respective stepper motor 262. According to block 2, if the yarn sensor motion signal matches the command signal, the tufting operation continues, as provided in block 3, and the yarn sensing electronics repeatedly compares the yarn sensing motion signals to the respective command signals. If the yarn sensing motion signal does not match the command signal, then, according to block 4, the tufting apparatus 10 automatically stops and a visual alarm is activated indicating the particular yarn supply module 250 where the error has occurred and the particular yarn which is in error. The visual alarm comprises a plurality of LEDs 334 and 336 mounted to the top 261 of the yarn sensing frame 258. One of LEDs 334 is positioned proximate the end of the yarn supply module 250 distal from the tufting frame 12 and indicates at which module the error has occurred. The other LEDs 336 correspond to each of the yarns controlled by the respective yarn supply module 250 and are positioned above respective stepper motors 262 and yarn sensing mechanisms 312 to indicate the particular yarn which is in error. According to block 5, the operator, after identifying the yarn in error, corrects the problem which may be a broken or jammed yarn. The operator then restarts the tufting apparatus 10 according to block 6 by pressing a reset button 338 mounted on the yarn supply module 250 which restarts the pneumatic supply system 26 and signals the tufting apparatus control system 30 to restart normal operation of the tufting apparatus at the point of interruption by the yarn sensing module 310.

Each yarn supply module 250 is mounted on a separate yarn supply manifold 340 which is mounted to the tufting frame 12. The yarn supply manifold 340 supplies pressurized air to the flexible yarn supply tubes 354 and transports the yarns to and through the needles 18. Each yarn supply manifold 340 comprises a manifold bar 342 mounted at one end to the tufting frame 12 and extending downwardly and outwardly from the main drive housing 64. Each manifold bar 342 comprises a pair of spaced mounting pins (not shown) which receive the L-shaped slots in the frame 252 of the respective yarn supply module 250. By sliding the yarn supply module 250 along the pins in the L-shaped slots 256, the yarn supply module 250 can be selectively shifted manually between the operating position, proximate the tufting frame 12, and a maintenance position more distal from the tufting frame.

The manifold bars 342 also have a plurality of yarn passages 346, one for each yarn handled by the respective yarn supply module 250. The yarn passages 346 extends from an inlet 348 to an outlet 350 and are aligned with the yarn exit passages 300 of the corresponding yarn guide plates 290 when the yarn supply module 250 is in the operating position. The yarns are pulled through the yarn passages 346 by pressurized air flowing through corresponding air passages 352 in the manifold bar 342. The air passages 352 extend from inlets 353 to the respective yarn passages 346 in the manifold bar between the inlet 348 and outlet 350 of the yarn passages. Flexible yarn supply tubes 354 extend from the manifold yarn passage outlets 350 to the inlets of corresponding yarn passages 146 in the needle mounting bar 140. Thus, when the yarn supply manifold 340 receives a flow of pressurized air, the air flows into the inlet 348 of the manifold yarn passage 346, the yarn supply tube 354, the yarn passage 146 in the needle mounting bar 140, the tunnel 148 in the funnel bar 142, and the needle 18, and out of the needle tip 166 to feed yarn to the needle during reciprocation of the needle.

Each yarn supply tube 354, in conjunction with the corresponding needle mount passage 146, funnel 148, and needle 18 defines a respective yarn feed path extending from the outlet 350 of the manifold yarn passage 346, through the respective yarn supply tube 354, to the needle outlet tip 166. Because the yarn supply modules 250 are fixed to the tufting frame 12 and stationary, the distance of the yarn feed paths remain the same during reciprocation of the needles 18 and the needle drive system 20 and the reciprocation of the needles and needle drive system does not cause movement of the yarn relative to the feed path. As will be explained further below, this allows yarn to be fed to the needles 18 during the entire reciprocation cycle of the needles.

Pressurized air is supplied to the yarn supply manifolds 340 via a high pressure supply pipe 356 and a low pressure air supply pipe 358, both of which form part of the pneumatic supply system 26. The high and low pressure air supply pipes 356 and 358 are connected to valves operated by air solenoids 360 via tubes 362 and 363. The air solenoids 360 direct either high or low pressure air to the manifold passages 346 through corresponding air feed tubes 366 which extend from the valves operated by the air solenoids 360 to corresponding air inlet passages 352 in the manifold bar 342. High pressure air from the high pressure air supply pipe 356 is supplied to the manifold yarn passage 346 carrying the yarn which is being fed and low pressure air is delivered from the low pressure air pipe 358 to each of the other manifold passages 346. The low pressure air is used to keep the yarns taut in the yarn supply tubes 354 without using an excessive amount of air. This results in some operational cost savings.

A controlled central injector system 367, shown in FIGS. 2A and 2B, feeds air to each funnel 148 in the funnel bar 142 via a high pressure supply pipe 368 and a low pressure supply pipe 370, both of which are mounted to the frame 12 and form part of the pneumatic supply system 26. The high and low pressure pipes 368 and 370 are connected to valves operated by air solenoids 372 via tubes 374 and 376. The air solenoids 372 direct either high or low pressure air to the funnels 148 through corresponding air feed tubes 378 which extend from the valves operated by the air solenoids 372 to corresponding air passages 144 in the needle mounting bar 140. There is a separate air solenoid 372, valve, and set of tubes 374, 376, and 378 for each funnel 148, and thus, for each needle 18. Each air solenoid 372 is independently controlled by the control system 30 so that high or low pressure air may be delivered to any needle 18 independently of the pressure that is being delivered to other needles.

High pressure air from the high pressure pipe 368 is supplied to a needle 18 when the yarn being fed to the needle is being changed, such as from one color yarn to another color yarn. Use of higher pressure air during yarn changing prevents tangling of the yarns as the yarns pass one another in the funnels 148 and alleviates jamming of the tufting apparatus. Low pressure air from the low pressure supply pipe 370 is supplied to the needles 18 at all times during operation of the tufting apparatus 10 except when yarns being delivered to the needles are being changed. When lower air pressure is being delivered to the needles 18, the evenness of the resulting carpet pile is better. In addition, limiting use of high pressure air to yarn changes can reduce the overall consumption of air by the tufting apparatus and save operational costs. The actual pressures of the high and low air pressure supplies will vary depending on factors such as the types and sizes of yarns, the size of the needles 18, and the speed of operation of the machine.

Yarn Management (Tube Header) System

Figure 21:
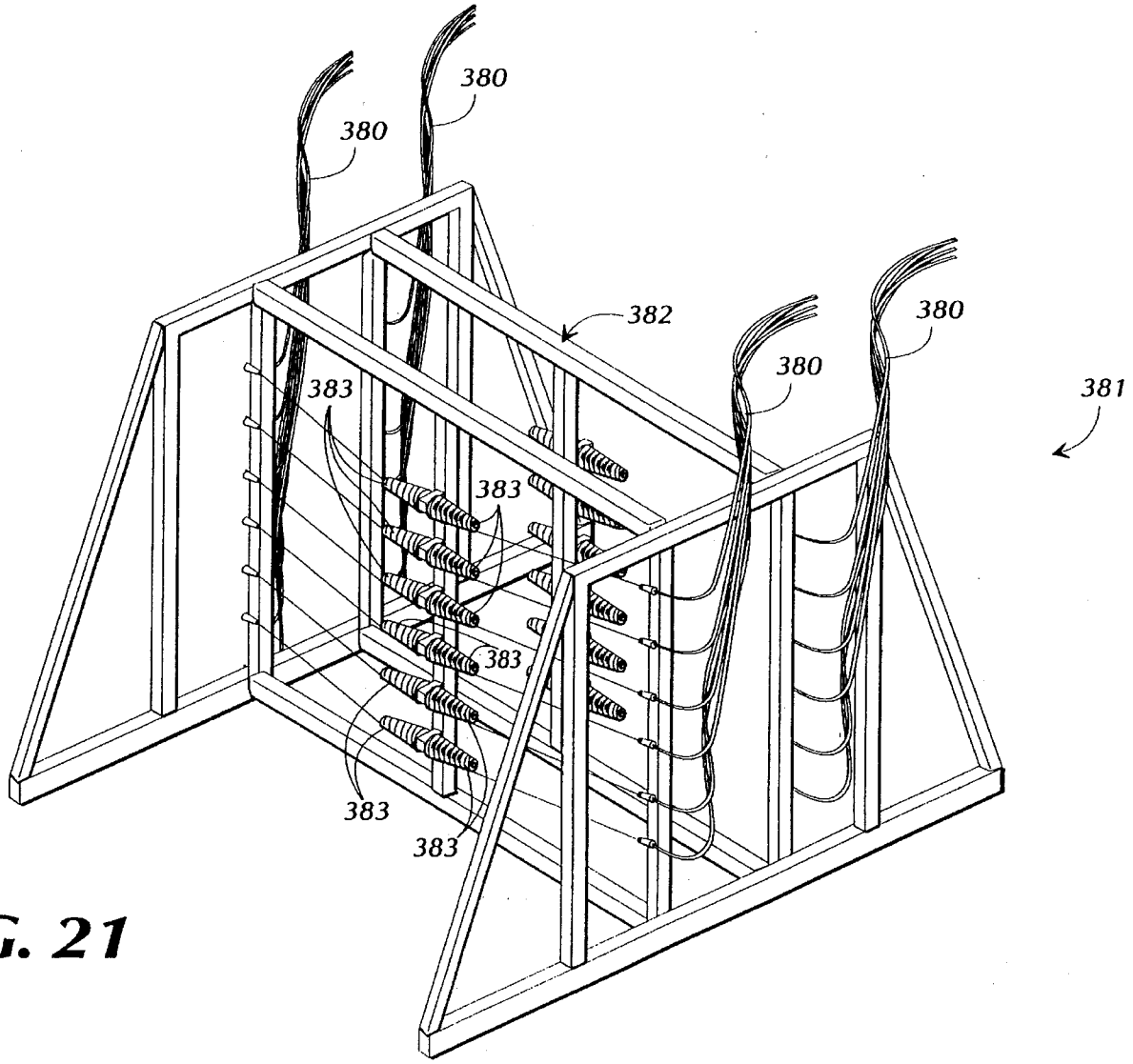
FIG. 21 is a perspective view of a creel for use with the tufting apparatus shown in FIG. 1.

Yarn is supplied to the tufting apparatus 10 and the yarn supply modules 250 through overhead tubes 380 from a creel 381. The creel 381 is best shown in FIG. 21 and generally comprises a frame 382 for holding a plurality of yarn spools 383. The structure and function of such creels is well known to those skilled in the art and is not discussed herein in detail. The overhead tubes are not illustrated in FIG. 1, but are shown in FIGS. 2A and 19.

Figure 19:
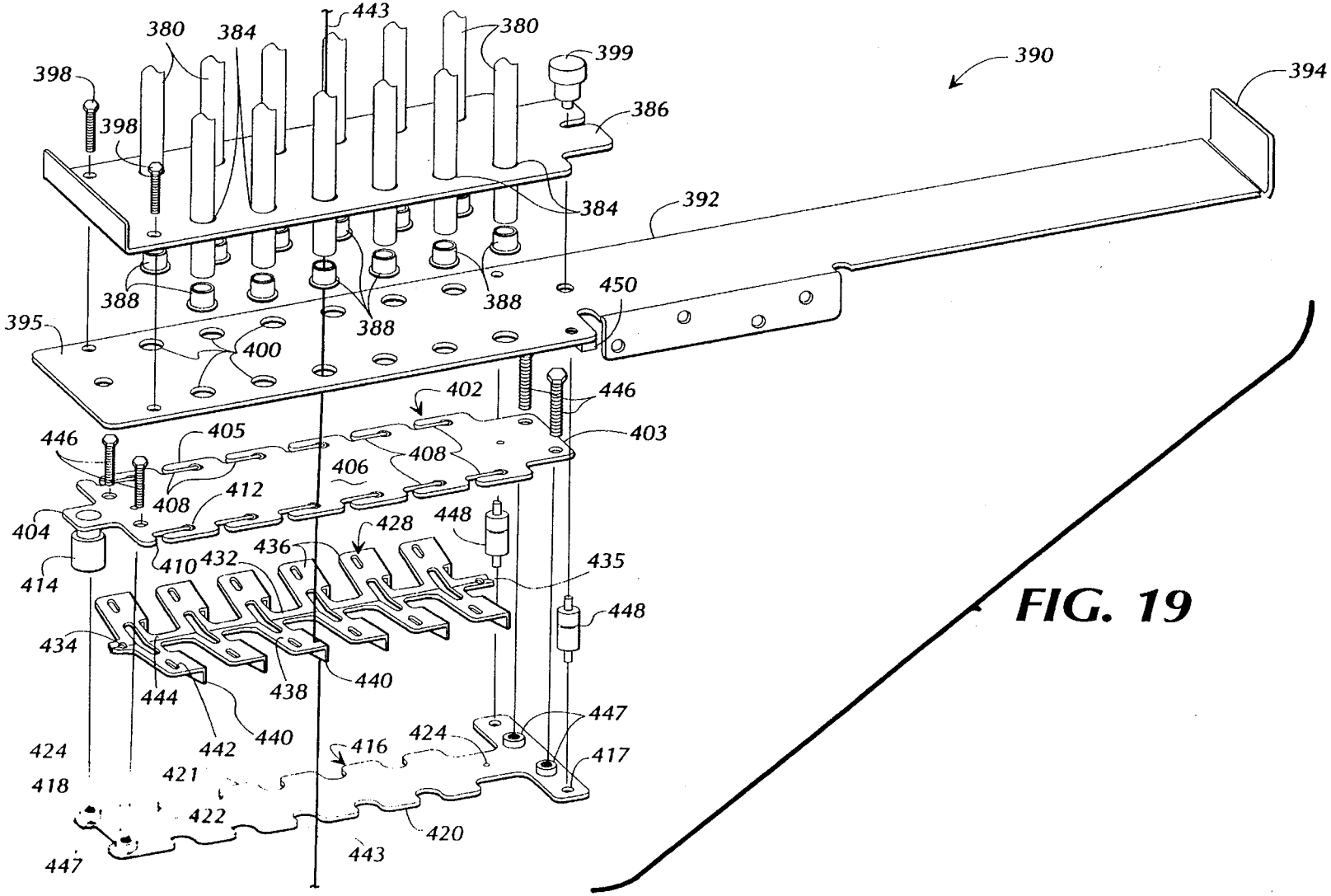
FIG. 19 is an exploded perspective view of two rows of overhead yarn tubes with corresponding tube headers.
Figure 20:
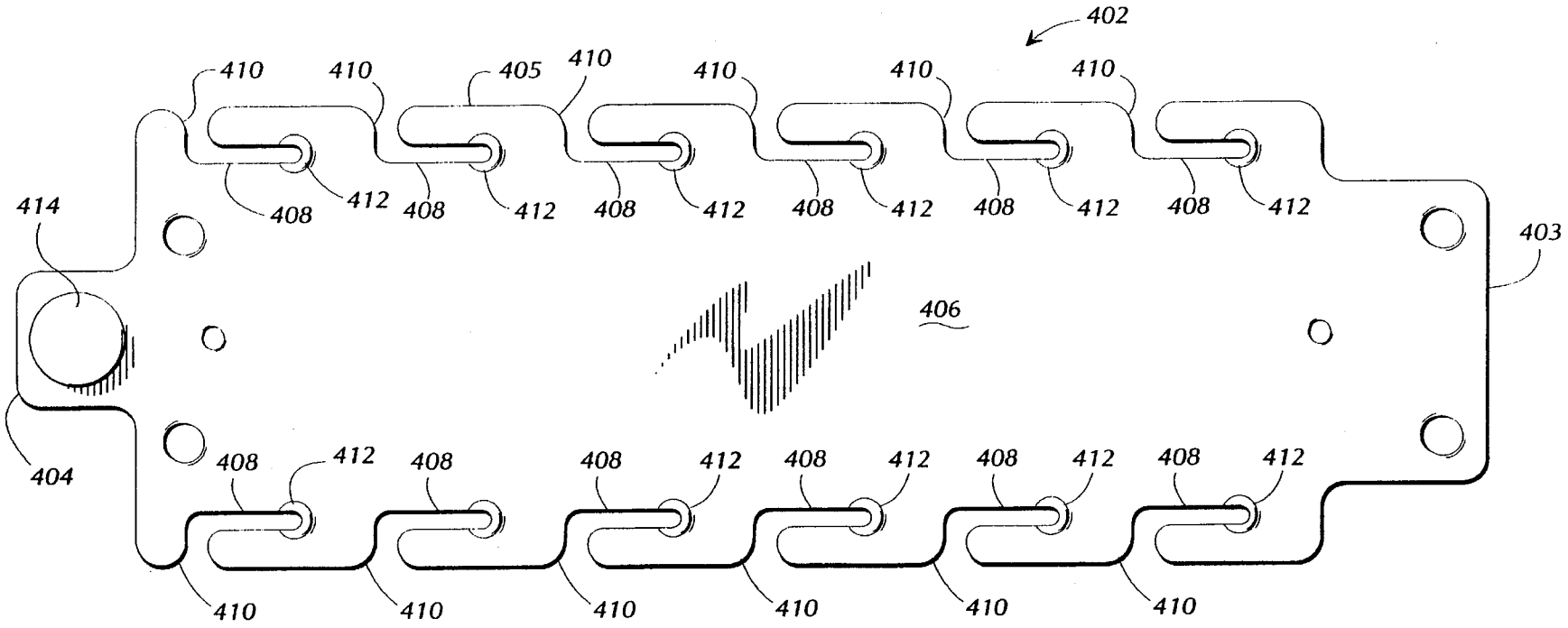
FIG. 20 is a plan view of a knot filter plate which forms part of the tube header shown in FIG. 18.

As illustrated in FIG. 19, the overhead tubes 380 fit through holes 384 in tube capture plates 386. Each tube capture plate 386 has two rows of six holes 384 and thus handles twelve tubes 380 and twelve yarns. There is one tube capture plate 386 for every two yarn supply modules 250. Tube exit inserts 388 fit into the ends of each of the overhead tubes 380 to constrain the tube openings and protect the yarn.

Each tube capture plate 386 forms part of a tube header assembly 390 which manages movement of yarn from the creel 381 and overhead tubes 380 to the yarn supply modules 250. The tube header assemblies 390 filter oversized portions of yarn, such as knots, which could jam the tufting apparatus 10, prevents free yarn spillage from the overhead tubes 280 due to vibrations caused by the tufting apparatus operation and maintains a minimum tension in the yarn from the tube header assemblies 390 back to the creel 381. In addition, the tube header assemblies 390 dampen vibration of the yarn extending between the tube header assemblies and the yarn supply modules 250. Vibrating yarns can contact one another and inhibit movement of the yarns through the yarn supply modules 250.

Each tube header assembly 390 further comprises a tube header bracket 392 extending from one end 394, which is fixed to the tufting frame 12 just above the yarn supply modules 250, to a distal end 395. Support brackets 396 (shown in FIG. 2A) extend from below the tube header bracket 392 to the tufting frame 12 and brace the tube header bracket. The tube capture plate 386 is disposed above the tube header bracket 392 proximate the distal end 395 and mounted to the tube header bracket with bolts 398 and a shoulder screw 399 such that the tube capture plate (and tubes) can slide out to access yarn control modules 464. The overhead tubes 380 extending through the tube capture plate 386 are aligned with two rows of six holes 400 in the tube header bracket 392 so that the yarns can be fed from the overhead tubes 380 straight through the holes in the tube header bracket.

The tube header assembly 390 further comprises a knot filter plate or member 402 extending from one end 403 which faces the tufting frame 12 to a distal end 404 which faces away from the tufting frame. The knot filter plate 402 has a peripheral edge 405 defining an interior portion 406 and a plurality of slots 408 for receiving the moving yarns. There is one slot 408 for each of the twelve yarns exiting the tube capture plate 386, The slots 408 extend from openings 410 at the peripheral edge 405 of the filter plate 402 towards respective interior ends 412 in the interior portion 406 of the filter plate. The slots 408 are L-shaped and extend inwardly from the openings 410 and then back towards the tufting frame 12 to the interior ends 412 so that the yarns are pulled by the stepper motors 262 towards the interior ends of the slots. As a result, the yarns are less likely to be pulled out of the slots 408 during operation of the tufting apparatus 10. The filter plate 402 further comprises a floating screw 414 attached to the distal end 404 of the filter plate for removably fixing the distal end of the filter plate to the distal end 395 of the tube header bracket 392.

The tube header assembly 390 further comprises a stop plate 416 disposed below the knot filter plate 402 and extending from one end 417 facing the tufting frame 12 to a distal end 418 facing away from the tufting frame. Lateral edges 420 and 421 extend between the ends 417 and 418 of the stop plate 416 and limit the travel of the yarn friction plate leaf springs 436. A pair of pins 424 extend upwardly from the stop plate 416 proximate the opposite ends of 417 and 418 of the stop plate 426 and receive a friction plate or member 428 which fits between the knot filter plate 402 and the stop plate 416. The friction plate 428 has a central body 432 with holes 434 and 435 at opposite ends of the central body for receiving the pins 424 of the stop plate 416.

The friction plate 428 further comprises a plurality of leaf springs 436, one leaf spring corresponding to each of the yarns and overhead tubes 380 such that there are six leaf springs extending from each side of the central body 432 of the friction plate. The leaf springs 436 each comprise a first portion 438 which fits against the knot filter plate 402 at the interior end 412 of a corresponding slot 408 and pinches the yarn as the yarn passes through the slot towards the yarn supply module 250. Each leaf spring 436 further comprises a second portion 440 which extends from the first portion 438 towards the stop plate 416 for protecting the yarn exiting the corresponding slot 408 through the corresponding recess 422 in the stop plate 416 to the yarn supply module 250. The first portion 438 of each leaf spring 436 has an opening 442 for viewing the yarn improperly pinched between the knot filter plate 402 and the friction plate 428, yet not in the interior end 412. In FIG. 19, the path of a single yarn 443 through the tube header assembly 390 is illustrated.

The central body 432 of the friction plate 428 has a longitudinal crease 444 so that the leaf springs 436 can be bent upwardly with respect to the central body. Thus, when the bent friction plate 428 is positioned between the knot filter plate 402 and the stop plate 416 and sandwiched therebetween, the leaf springs 436 are forced against the knot filter plate and pinch the yarns passing between the filter plate and the friction plate.

The knot filter plate 402 is fixed to the stop plate 416 with bolts 446 extending through opposite ends of the knot filter plate to captive nuts 447 in the top of the stop plate. The one end 417 of stop plate 416 facing the tufting frame 12 is connected to the midsection of the tube header bracket 290 with hinges 448 so that by loosening the floating screw 414, the knot filter plate 402, friction plate 428, and stop plate 416 can be pivoted downwardly from the tube header bracket 392 for access to the yarns extending through the tube header assembly 390. Pads 450 fixed to the underside of the tube header bracket 392 adjacent to the hinges 448 cushion the end 417 of the stop plate 416 facing the tufting frame 12 when the stop plate is released from the tube header bracket and pivoted downwardly. Additional pads (not shown) are attached to the underside of the tube header bracket 392 between the holes 400 in the header bracket for dampening vibration of the tube header assembly 390.

The slots 408 in the knot filter plate 402 are sized so that oversized portions of the yarns cannot pass through the slots and are held by the knot filter plate at the slot. When an oversized portion of yarn is caught by a tube header assembly 390, an associated sensing module 310 stops the tufting apparatus and alerts the operator of the problem yarn. The operator can then release the offending yarn from the tube header assembly 390 by pulling the yarn above the leaf spring 436 towards end 404 of the knot filter plate 402, thus freeing the yarn from the slot 408 completely, and then, remove the knot, splice the yarn with a smaller knot, guide the yarn into the opening 410 of the knot filter plate, into the associated slot, and above the associated leaf spring, and restart the tufting apparatus 10 by punching the reset button 338 on the associated yarn supply module 250.

The friction plate 428 is preferably made of a thin metal sheet so that the friction plate (1) is flexible and provides a suitable amount of spring force to the yarns and (2) grounds the yarn passing therethrough so as to bleed off the static electricity in the yarns.

The Control System

Figure 22:
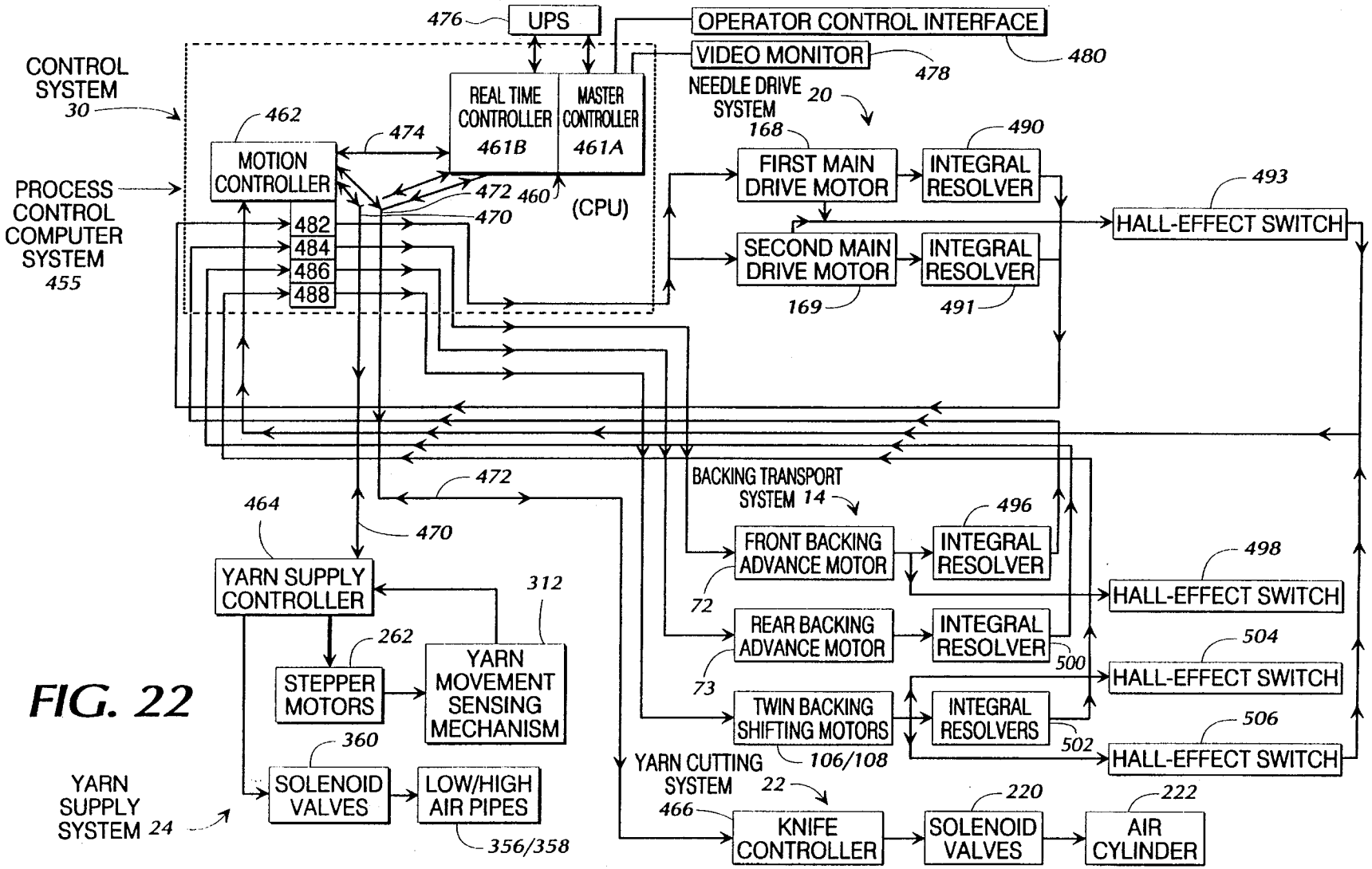
FIG. 22 is a schematic block diagram of the control system for the tufting apparatus shown in FIG. 1.

The control system 30 of the tufting apparatus generally receives instructions from an operator for making a particular product such as a patterned carpet and controls the various subsystems of the tufting apparatus, including the backing transport system 14, the needle drive system 20, the yarn cutting system 22, and the yarn supply system 24, in accordance with the operator's instructions to make the desired product. As shown in the schematic diagram of FIG. 22, the control system 30 for the overall tufting apparatus 10 comprises a process control computer system 455, which is a personal computer positioned remote from the tufting frame 12, a number of yarn supply controllers 464 distributed along the tufting frame, and a knife controller 466 mounted to the tufting frame. The process control computer system 455 comprises a central processing unit (CPU) 460 and a motion controller 462. The function of each of the components of the control system 30 is described below in enough detail such that one skilled in the art can obtain or prepare the appropriate software to carry out the respective functions.

The CPU 460 desirably includes a pair of 486-based 66 MHz CPU boards, one of which is referred to as a master controller 461A and the other of which is referred to as a real-time controller 461B. Desirably the CPU 460 is of industrial construction for operation in hot, humid environments.

The CPU 460 is programmed with operator utilities software and run-time software. The operator utilities include functions such as selecting patterned files from a floppy or the hard drive, decompressing or compressing pattern files, changing pattern colors, setting up the creel, and performing diagnostic functions with the yarn control input/output. Desirably, patterns such as multicolored patterns for carpet are scanned using a conventional multicolor pattern scanning device, translated into a pattern file, and downloaded onto a floppy disk or the hard drive of the CPU 460. The operator can also input instructions for the timing of the tufting operation.

The run-time software is the code that controls the yarn colors and pattern generation during operation of the tufting apparatus 10. The run-time software allocates the pattern information from the pattern file to the correct needles 18 at the correct time relative to the position of the main drive shaft 128, sends the necessary pattern or yarn/color information to all of the yarn supply controllers 464 at the correct time via one or more differential serial buses 470, allocates pattern information from the pattern files to the appropriate knife blades 170 at the correct time relative to the main shaft position, and sends the pattern information to the knife controller 466 at the correct time via a differential serial bus 472. Desirably, the tufting cycle (one rotation of the main drive shaft 128) is 60 msec, which is the time it takes to run one cycle at a speed of 1000 rpm.

The CPU 460 is connected to an uninterruptable power supply 476 so that during local power outages, the tufting apparatus 10 can be restarted where the operation was interrupted. The master controller 461A of the CPU 460 is connected to a video monitor 478 for displaying the pattern being used by the CPU and the amount of the pattern which has been completed by the tufting apparatus at any time. In addition, the master controller 461A of the CPU 460 is connected to an operator control interface 480 which is desirably a touch screen that enables the operator to stop and start the tufting apparatus and input data such as stitch gauge and other pattern parameters.

The motion controller 462 controls and coordinates the large motors mounted on the tufting apparatus 10. These motors include the main drive motors 168 and 169 which control the needle 18 reciprocation, the front and rear backing advance motors 72 and 73, and the twin backing shifting motors 106 and 108. The motion controller 462 controls the needle drive system 20 by controlling the speed of rotation of the main drive shaft 128, and controls the backing transport system 14 by coordinating the motion of the backing advance and shifting motors 72, 73, 106, and 108 with the main drive shaft. The motion controller 462 communicates with the real-time controller 461B via a bus 474 within the personal computer 455. In addition, the motion controller 462 generates data representing the position and speed of movement of the needle, receives data for use in deriving timing signals for controlling the timing of the stepper motors, derives the timing signals by manipulating the needle position and speed data and the timing signal data, and transmits the timing signals to the yarn supply controllers 464 and the knife controller 466.

The motion controller 462 includes a computer, and a number of servo-motor drivers 482, 484, 486, and 488. The computer is desirably a Galil Model 1040 motion controller manufactured by Galil Motion Control, Inc. of Sunnyvale, Cal.

The servo-motor drivers include a pair of servo- motor drivers 482 for the main drive shaft motors 168 and 169, a servo-motor driver 484 for the front backing advance motor 72, a servo-motor driver 486 for the rear backing advance motor 73, and a pair of servo-motor drivers 488 for the twin backing shifting motors 106 and 108. Integral resolvers 490 and 491 send signals to the main drive shaft servo-drivers 482 indicating the rotor angles of the main drive shaft motors 168 and 169. A hall-effect proximity switch 493 provides feedback to the motion controller 462 to home the main drive shaft motors 168 and 169 and the reciprocation of the needles 18. Likewise, an integral resolver 496 transmits signals to the front backing advance motor servo-driver 484 indicating the rotor angle of the front backing advance motor 72 and a hall-effect proximity switch 498 sends signals to the motion controller 462 for homing the backing transport system 14. Integral resolvers 500 and 502 transmit signals indicating the rotor angles of the rear backing advance motor 73 and the twin backing shifting motors 106 and 108, respectively, to the rear backing advance motor servo-driver 486 and the twin backing shifting motor drivers 488. Hall-effect proximity switches 504 and 506 transmit signals to the motion controller 462 for disabling the tufting apparatus if the over limits of the twin backing shifting motors 106 and 108 are reached.

The yarn supply control modules 464 receive timing signals from the motion controller 462 and pattern data from the CPU 460, both via the serial buses 470, and control the motion and timing of the stepper motors 262 and the air solenoid valves 360. In addition, the yarn control modules 464 receive signals from the yarn sensing modules 310 for stopping the tufting operation when a yarn is jammed or broken and transmits that data to the CPU 460.

The yarn control modules 464 are mounted to and distributed along the tufting frame 12 as best shown in FIG. 12. In that embodiment, each yarn control module 464 controls four yarn supply modules 250. The yarn control modules 464 are distributed along both sides of the main drive shaft housing 64 just above the tube header brackets 392. One of the serial busses 470 extends along one side of the tufting frame 12 and the other of the serial busses extend down the other side of the tufting frame. In the embodiment shown in FIG. 1, there are 22 yarn control modules 464 on each side of the tufting frame 12.

Figure 23:
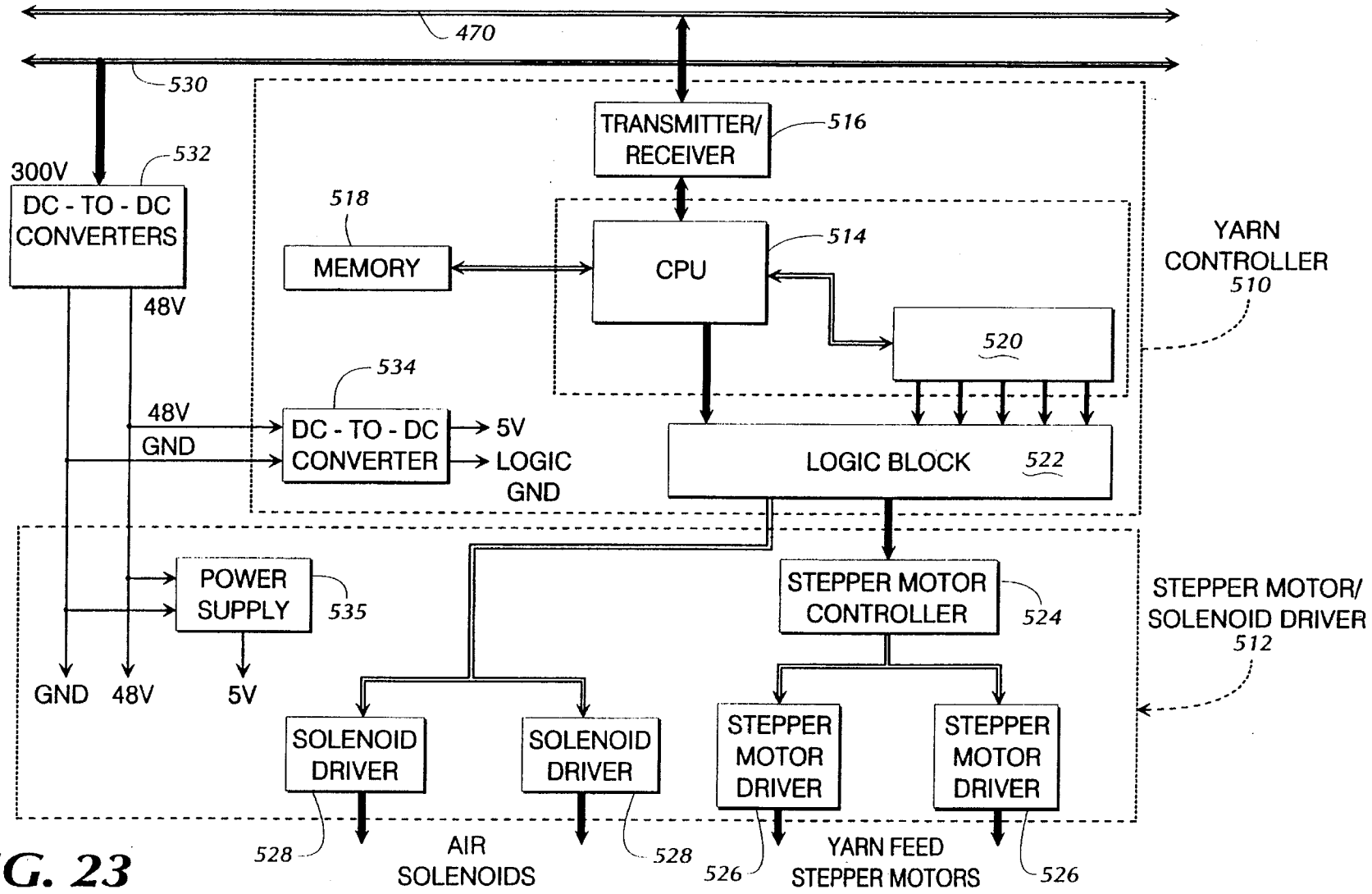
FIG. 23 is a schematic block diagram of a yarn controller which forms part of the control system illustrated in FIG. 21.

A schematic diagram of a yarn control module 464 is shown in FIG. 23. Each yarn control module 464 includes a yarn controller 510, which controls four yarn supply modules 250, and four stepper motor/solenoid drivers 512, one for each of the yarn supply modules controlled by the yarn controller.

Each yarn controller 510 comprises a microcontroller 514, such as a Motorola 68HC16 microcontroller available from Motorola of Phoenix, Arz., for receiving pattern data and timing signals from the CPU 460 via the respective serial bus 470. The microcontroller 514 also transmits data to the CPU 460 such as a signal indicating shut down of the tufting apparatus 10 due to yarn breaks or jams. In addition, the microcontroller 514 also sends requests to the CPU 460 for more pattern information. A differential transmitter/receiver 516 communicates between the microcontroller 514 and the respective serial bus 470. The microcontroller 514 contains built-in timers to create precise individual timing signals for the stepper motor/solenoid drivers 512. The serial bus 470 has multiple distributed nodes along the bus for connection to the microcontroller 514 of each yarn controller 510 distributed along the tufting frame 12. Each yarn controller 510 has a discrete address.

The yarn controller 510 further includes additional memory 518 for storing additional pattern data and stepper motor ramps 520 to create precise individual timing signals for the stepper motor/solenoid drivers 512. A logic block 522 transmits commands to the stepper motor/solenoid drivers 512 as logic level signals through cross point switches in the logic block. Each yarn controller 510 controls 24 stepper motors 462 and the cross point switches direct the appropriate commands to the appropriate stepper motors.

Each stepper motor/solenoid driver 512 comprises a stepper motor controller 524 for receiving the logic level signals from the yarn controller 510 and directing those commands to stepper motor drivers 526 which power the stepper motors 462. There are six stepper motor drivers 526 for each stepper motor/solenoid driver 512 and thus for each yarn supply module 250. However, only a maximum of two stepper motors 262 per yarn supply module 250 are moving at any one time. One stepper motor driver 526 may be retracting a yarn while the other stepper motor driver feeds another yarn to the respective needle.

Each stepper motor/solenoid driver 512 also comprises six solenoid drivers 528 for driving six solenoid valves 360. The solenoid valves direct either high pressure air from air pipe 356 or low pressure air from air pipe 358 to the yarn supply tubes 354 associated with the respective stepper motors 262. Typically, the stepper motors 262 which are being driven by the stepper motor drivers 528 are moving yarn through yarn supply tubes 354 through which the solenoid drivers 528 are directing high pressure air.

Power rails 530 extending along tufting frame 12 provide power to the yarn control modules 464. The power rails provide high voltage DC power (300 volts DC) which must be converted to lower voltage for powering the yarn control modules 464, the stepper motors 262, and solenoid valves 360. Power converter modules 532 are mounted to and distributed along the main driver housing 64 of the tufting frame 12 above the yarn supply control modules 464 for converting the high voltage power delivered by the power rails 530 to a lower voltage. In the embodiment shown in FIG. 1, there is one power converter module 532 for each yarn control module 464. In the disclosed embodiment, the power converter modules 532 convert the 300 volt power to 48 volt power. This power is then fed to the yarn control modules 464 wherein the power is further converted through power converters 534 and 535 to 5 volts for powering the logic level components of the yarn controller 510 and stepper motor/solenoid drivers 512.

Figure 25:
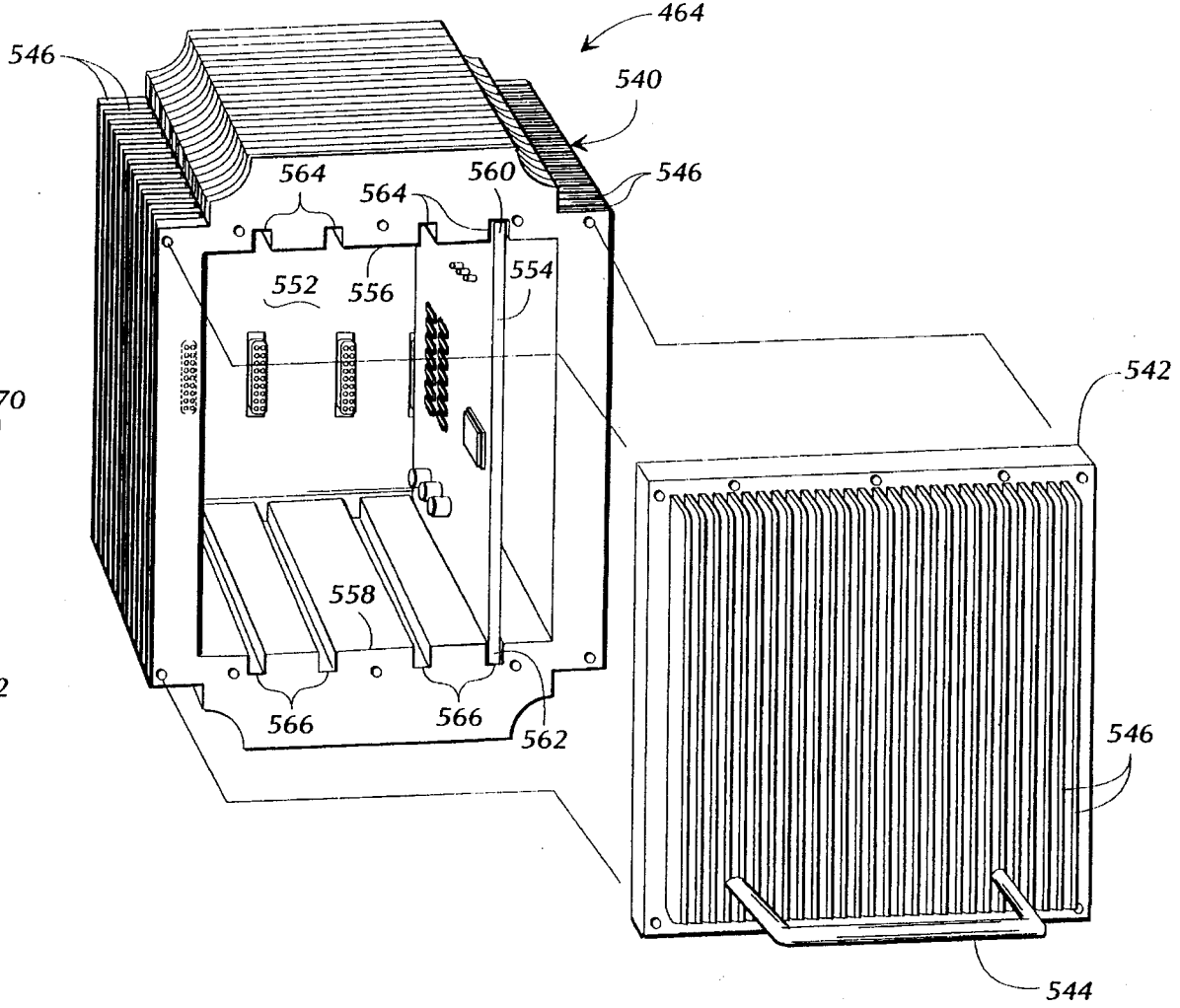
FIG. 25 is a perspective view of the yarn control module shown in FIG. 24 with the yarn control module housing open.
Figure 24:
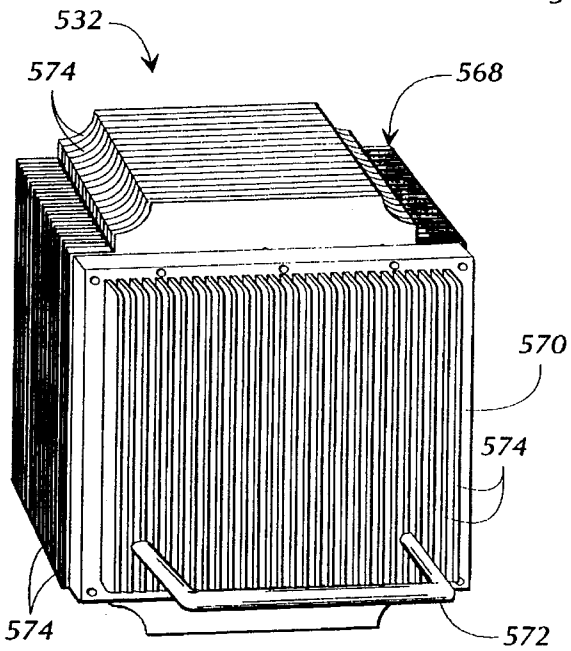
FIG. 24 is a perspective view of a power supply module and a yarn control module of the tufting apparatus shown in FIG. 1.

The mechanical structure of a yarn control module 464 and a power converter module 532 is shown in FIGS. 24 and 25. As can be seen, the yarn control module 464 comprises a cubicle housing 540 having a removable front panel 542. The front panel 542 has a handle 544 for easy handling of the front panel. The housing 540 is desirably made of metal such as steel or aluminum and has fins 546 projecting outwardly from all sides of the exterior of the housing for cooling the housing. The housing 540 is attached to a mounting frame 548 with bolts 550. The mounting frame 548 is then mounted on the tufting frame 12. The serial busses 470 and the power rails 530 are mounted within the mounting frame 548.

The yarn control module 464 comprises a circuit board 552 on which is mounted the circuitry of the yarn controller 510. This circuit board 552 forms the rear panel of the yarn control module housing 540, which faces the mounting frame 548, and plugs directly into the serial bus 470 and the associated power converter module 532. The yarn control module 464 further comprises four of the stepper motor/solenoid drivers 512. The circuitry of each stepper motor/solenoid driver 512 is mounted on separate circuit boards 554 which are disposed within the housing 540, plug directly into the yarn controller circuit board 552, and extend vertically between the top 556 and bottom 558 of the housing. The stepper motor/solenoid driver circuit boards 554 are mounted on aluminum plates, the upper and lower edges 560 and 562 of which fit into corresponding channels 564 and 566 in the top 556 and bottom 558 of the housing 540 so as to dissipate heat generated by the electronics to the housing and outwardly through the fins 546.

The housing 540 of the yarn control module 464 protects the yarn controller 5 10 and stepper motors/solenoid driver 512 circuitry from contamination by textile fibers and the like and from damage caused by other factors such as heat and humidity.

The power converter modules 532 comprise a housing 568 very similar to the housing 540 of the yarn control module 464. The housing 568 of the power converter is cubicle and fully enclosed, and has a removable front panel 570 with a handle 572 attached thereto. The power converter housing 568 also comprises cooling fins 574 extending from all sides of the exterior of the housing. The power converter housing 568 is bolted to the mounting frame 548 just above the 10 yarn control module 464. The electronics of the power converter 532 is not disclosed herein in detail as such is known to those skilled in the art. Desirably, the power converter module 532 plugs directly into the associated power rail 530.

Figure 26:
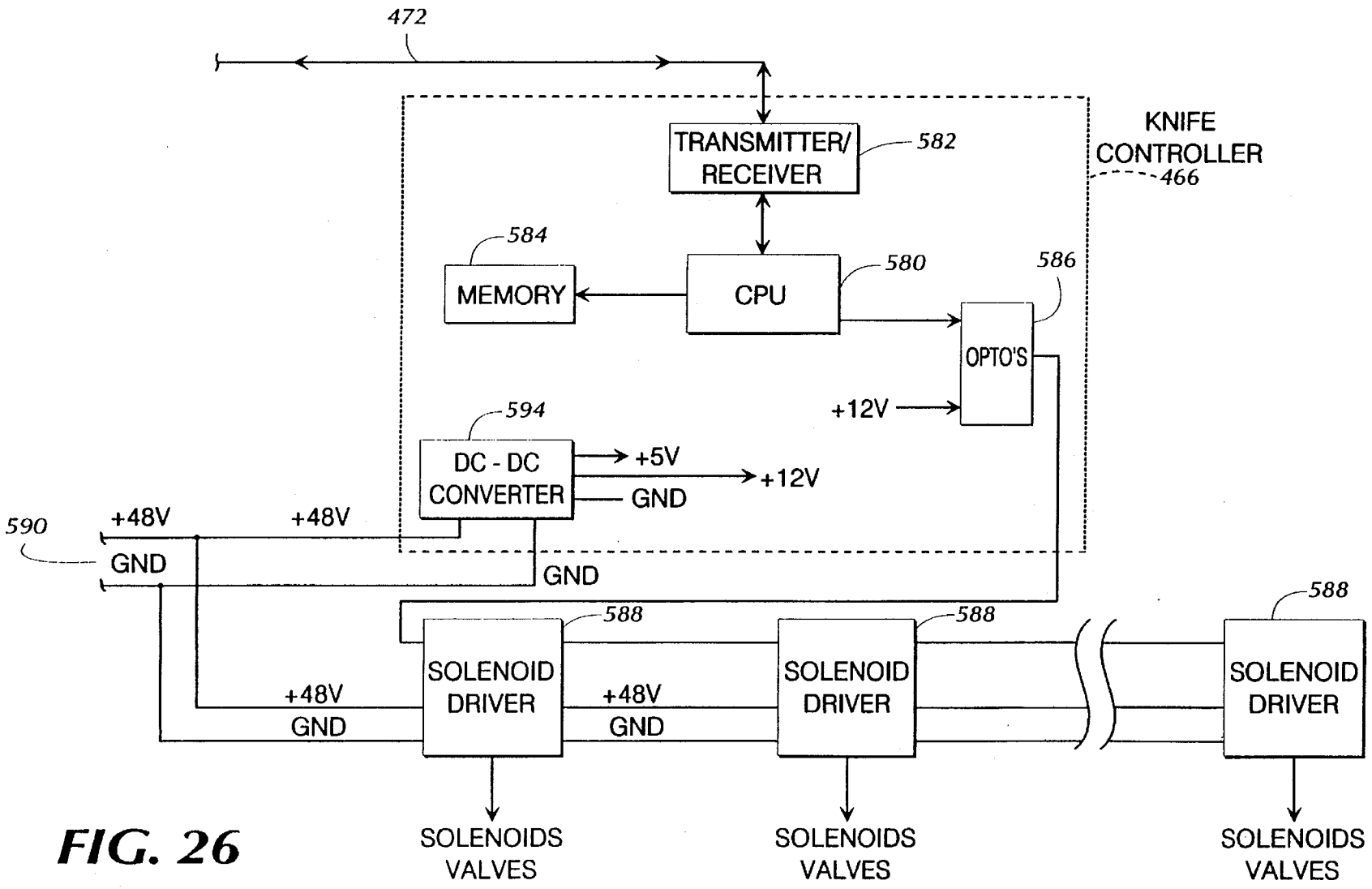
FIG. 26 is a schematic block diagram of the control system for the cutting system of the tufting apparatus shown in FIG. 1.

A schematic diagram of the knife controller 466 is shown in FIG. 26. As can be seen, the knife controller 466 comprises a microcontroller 580, such as a Motorola 68HC16 microcontroller available from Motorola of Phoenix, Arz., which obtains pattern data and timing 20 signals from the CPU 460 via the serial bus 472. The microcontroller 580 communicates with the serial bus 472 via a differential transmitter/receiver 582 and interfaces to memory 584 for storing the software program and pattern data. The microcontroller 580 25 transmits commands through an optical isolator (opto's) 586 to solenoid drivers 588. The solenoid drivers 588 then drive the solenoid valves 220 which, in turn, power the air cylinders 222. Power is provided to the knife controller 466 via a 48 volt DC power bus 590. The 30 power to the optoisolaters 586 and to the microcontroller 580 and other circuitry is further reduced to 12 volts and 5 volts, respectively, by converter 594. The solenoid valves are powered by 48 volts.

The controlled central injector system 367 is 35 controlled by the control system 30 of the tufting apparatus 10 in the same manner that the air solenoid valves 360 for directing high or low pressure air through the yarn supply manifolds 340 are controlled. Although not shown in the schematics of FIGS. 22 and 23, the air solenoid valves 372 of the controlled central injector system 367 can be controlled by the yarn supply controllers 464 or by independent controllers. In either scheme, the air solenoids 372 of the controlled central injector system 367 are controlled in accordance with timing signals from the motion controller 462 and pattern data from the CPU 460. Just prior to a yarn change for a particular needle 18, the associated air solenoid 372 switches from low pressure air supplied by the low pressure air supply pipe 370 to high pressure air supplied by the high pressure air supply pipe 368 to facilitate the yarn change. Then, after the yarn change, the associated air solenoid 372 switches back to low pressure air.

Operation of the Tufting Apparatus

Once the tufting apparatus 10 is properly set up, the tufting apparatus can produce, in one pass, a tufted multicolored patterned carpet. The tufting apparatus 10 is set up to deliver up to six different yarns to each needle, but it should be understood that the tufting apparatus could be set up to produce carpet having a pattern with more than six colors. In addition, the tufting apparatus 10 can produce a patterned carpet having some cut tufts and some loop tufts. The cut and loop tufts can be arrange to form a pattern themselves.

To set up the tufting apparatus 10, the CPU 460 is programmed with the appropriate pattern and timing data using the operator control interface 480, the air pressures for the yarn supply system 124 and the presser foot 238 are set to levels appropriate for the types of yarns being used, the backing 16 is fed into the backing transport system 14, and the yarns are mounted on the creel 382 and fed through the overhead tubes 380, the tube header assemblies 390, the yarn supply modules 250, and the yarn supply tubes 354 to the needle drive system 20.

The CPU 460 is programmed with the stitch gauge of the pattern being used so that the backing advance motors 72 and 73, the backing shifting motors 106 and 108 and the main drive motors 168 and 169 cooperate to reproduce the desired pattern in the tufted product. For example, because the needles 18 in the tufting apparatus 10 are spaced 1" apart, if the gauge, which is the spacing between the adjacent tufts, is 10, then there are ten tufts per inch along a transverse row of tufts. Accordingly, the backing shifting motors 106 and 108 must shift ten times per inch to produce the transverse movement of the backing 16. To produce a tufted product without visible interfaces between stitches made by adjacent needles, the backing advance motors 72 and 73 must move constantly while the backing shifting motors 106 and 108 shift incrementally back and forth during tufting by the needles 18. This actually produces a chevron pattern of tufts which, in a finished tufted product, is not visible on the face of the product. The method for producing such a chevron pattern is disclosed in detail in U.S. Pat. No. 5,205,233, the disclosure of which is incorporated herein in its entirety.

The tufting operation is begun by the operator by sending a start signal to the CPU 460 through the operator controller interface 480. The backing transport system 14, the needle drive system 20, the yarn cutting system 22, and the yarn supply system 24 then begin simultaneous operation to produce carpet having the pattern being implemented by the CPU 460. Each full rotation of the main drive shaft 128 is a cycle of the tufting apparatus 10. Through the adjustable cam assemblies 120 and the link assemblies 122, the needles 18 are reciprocated by the rotation of the main drive shaft 128. For every rotation of the main drive shaft 128, the needles 18 reciprocate through a full cycle which includes a downstroke and upstroke. During each reciprocation cycle of the needle drive system 20, the needles 18 can implant a yarn tuft into the backing 16. As the backing advance motors 72 and 73 advance the backing 16 and the backing shifting motors 106 and 108 move the backing transversely to the direction of advancement of the backing, the reciprocating needles 128 penetrate the backing and implant yarn in the backing successively along transverse rows.

During each cycle of the tufting apparatus 10, yarns are fed to the needles 18 by the stepper motors 262 in the yarn supply system 24. The stepper motors 262 can feed a yarn to each needle 18 during each stroke so that a yarn is tufted by each needle at each penetration of the backing 16 by the needles. In accordance with data sent by the CPU 460 to the yarn supply controller 464, the yarn supply controllers command the stepper motors 262 in each yarn supply module 250 to either feed yarn, retract yarn, or hold yarn in accordance with the pattern being implemented by the CPU. During each cycle of the tufting apparatus, one stepper motor 262 of each yarn supply module 250 can be feeding yarn while another of the stepper motors in each yarn supply module is retracting the yarn previously fed. The remaining stepper motors 262 on the yarn supply modules are holding yarn.

As a yarn is fed by a stepper motor 262, the yarn is drawn through the respective flexible yarn supply tube 354 by high pressure air supplied by the high pressure pipe 356. The yarns not being used are held taut by low pressure air supplied from the low pressure air pipe 358 and directed through the remaining yarn supply tubes 354. The high pressure air forces the yarn being fed through the respective funnel 148 and out of the tip 166 of the respective needle 18. During yarn changes for a particular needle 18, yarn tangling in the respective funnel 148 is prevented by switching the air supplied to the respective central air passage 144 in the needle mounting bar 140 from low pressure to high pressure. After the yarn change the air supplied to the central air passage 144 is switched back to low pressure.

A full tuft of yarn is the stitch implanted by the full stroke of the needle. During the operation of the tufting apparatus 10, a portion (approximately one-half) of the length of a yarn tuft is fed on the upstroke of the needle reciprocation cycle and the remaining portion (approximately one-half) of the length of the tuft of yarn is fed through the needle on the downstroke of the needle reciprocation cycle. This is illustrated in FIGS. 27A–E and 28A–E.

The yarn feed system of the tufting apparatus 10 disclosed herein is illustrated schematically in FIGS. 27A–E. This should be compared to the yarn feed system of a prior art design illustrated in FIGS. 28A–E. In FIGS. 27A–E and 28A–E, a full needle reciprocation cycle is illustrated, including both the downstroke and the upstroke. In FIGS. 27A–E, a simplified arrangement of a hollow needle 18, a funnel bar 142, a needle mounting bar 140 and a flexible yarn supply tube 354 is illustrated. X represents the stationary yarn supply system 24 which includes a stationary air manifold for blowing air through the yarn supply tube 354. The yarn Z extends along the yarn feed path which extends from the manifold 340 at X to the outlet tip of the needle 18. The letters A–D represent half-tuft yarn lengths and the letter E is a reference point along the yarn Z indicating how much yarn is fed from the stationary yarn supply system 24 during the needle reciprocation cycle. The distance X-Y represents the length of yarn extending between the exit of the stationary yarn supply system 24 and the inlet of the reciprocating needle drive system.

As can be seen from FIGS. 27A–E, the length of the yarn feed path does not change because the yarn travels through the flexible yarn supply tube 354 extending from the stationary yarn supply system 24 and manifold to the reciprocating needle drive system. During the entire needle reciprocation stroke, the length of yarn between points X and Y does not change. As a result, the yarn Z does not move relative to the yarn feed path during reciprocation of the needle drive system unless the yarn Z is being fed or retracted by the stepper motors 262. Because the yarn Z does not move relative to the yarn feed path unless forced by the stepper motors 262, the yarn can be fed during the downstroke and the upstroke of the needle reciprocation cycle. This allows for about half of a tuft length of yarn to be fed on the downstroke and about half of a tuft length of yarn to be fed on the upstroke.

In contrast, with the prior art tufting device illustrated schematically in FIGS. 28A–E, an entire tuft length of yarn must be fed during the downstroke. This limits the overall speed of the machine because of the limited speed with which a tuft length of yarn can be fed. The entire length of a tuft of yarn must be fed on the downstroke with the conventional apparatus because the needle drive system moves relative to the yarn during the needle reciprocation cycle regardless of whether yarn is being fed by the yarn supply system. In the conventional system, the air manifold 340'is mounted onto the reciprocating needle mounting block 140'and the funnel block 142'. Thus, the yarn Z is being pulled by the manifold from below the stationary yarn supply system at X and the needle drive system simply slides up and down on the yarn Z. This is illustrated by the changing length of yarn between points X and Z during the needle reciprocation cycle of the conventional apparatus. Because the yarn Z is not moving with the needle 18, the entire length of a tuft of yarn must be fed through the needle on the downstroke.

Figures 27A, 27B, 27C, 27D, 27E:
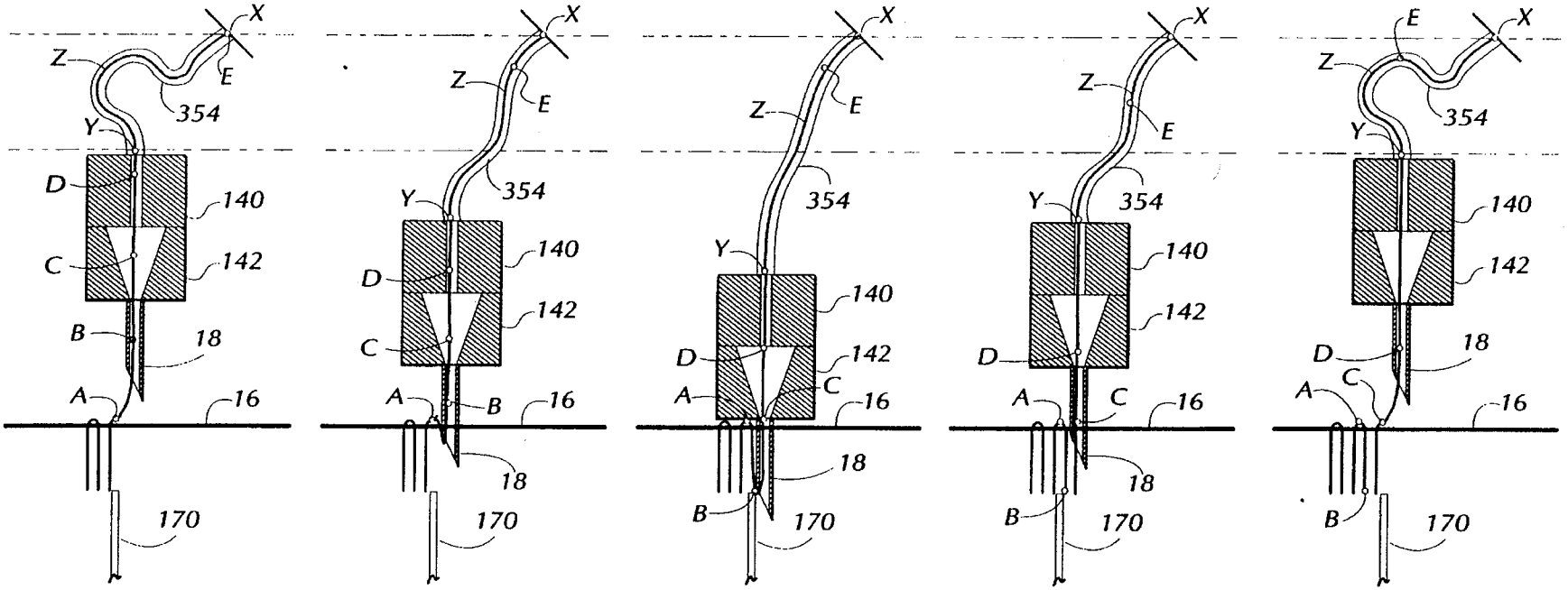
FIG. 27A–E are simplified schematic diagrams illustrating the movement of yarn through the tufting apparatus shown in FIG. 1.
Figures 28A, 28B, 28C, 28D, 28E:
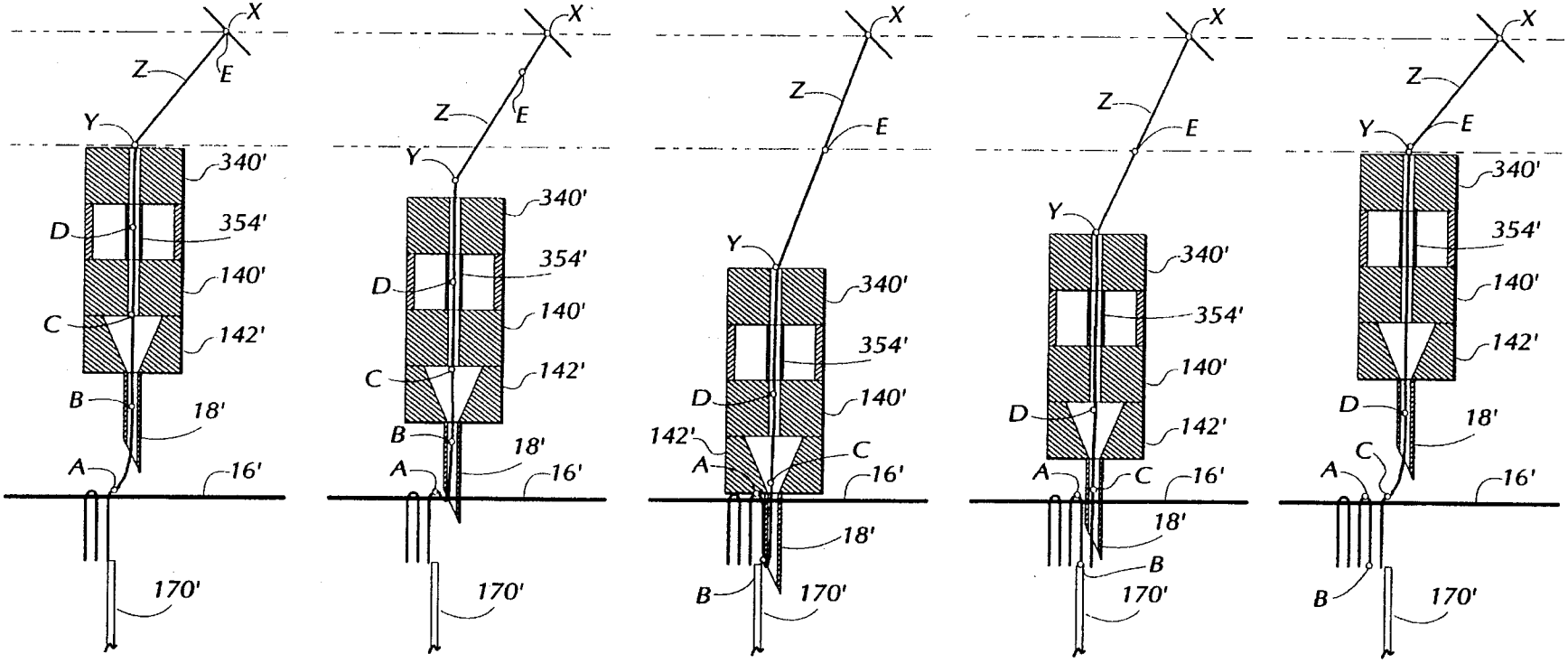
FIG. 28A (PRIOR ART)
FIG. 28B (PRIOR ART)
FIG. 28C (PRIOR ART)
FIG. 28D (PRIOR ART)
FIG. 28E (PRIOR ART)
FIG. 28A–E are simplified schematic diagrams illustrating the movement of yarn in a prior art tufting apparatus.

As can be seen from FIGS. 28A–C which illustrates prior art, the distance between points E and X is that of a full tuft length. In contrast, in FIG. 27C, which illustrates an embodiment of the present invention, the distance between points E and X is only one-half of tuft length. The remainder of the tuft length is fed on the upstroke as illustrated in FIGS. 27D and E. This allows for a higher number of revolutions per minute of the main drive shaft 128 and a higher production speed because the full needle reciprocation cycle can be used to feed yarn.

As explained hereinabove, during operation of the tufting apparatus 10 disclosed herein, the yarn movement sensing modules 310 sense yarn breaks or jams and automatically shut down the tufting apparatus and alert the operator as to the problem yarn when such breaks or jams occur. In addition, the tube header assemblies 390 filter out oversized portions of yarn such as knots by jamming the yarns having such oversized portions. When a tube header assembly jams such a yarn, the appropriate yarn sensing module 310 senses the jam and shuts down the tufting apparatus and alerts the operator of the problem yarn.

It should be understood that the foregoing relates to particular embodiments of the present invention and that numerous changes can be made therein without departing from the scope of the invention as defined by the following claims.

We claim:

1. Knife assembly for mounting to a frame and cutting yarn implanted into a backing by a hollow needle comprising:

a flat, elongate blade having longitudinal edges and a cutting edge extending between the longitudinal edges for shearing engagement with the needle;

a blade holder block having a passage for receiving the blade and a protrusion within the passage, the protrusion having a flat face; and a screw extending through the block into the passage for selectively engaging the flat blade and holding the blade flush against the flat face, and alternatively, releasing the blade, the longitudinal edges of the blade extending beyond the flat face when the blade is engaged by the screw so that the blade can flex and conform to the needle when the blade engages the needle.

2. Knife assembly as in claim 1 further comprising a member protruding from the block for engagement with the frame to prevent rotation of the block relative to the frame.

3. Knife assembly as in claim 2 further comprising means for reciprocating the block relative to the frame.

* * * * *